US010718181B2

(12) United States Patent
Saldanha et al.

(10) Patent No.: US 10,718,181 B2
(45) Date of Patent: Jul. 21, 2020

(54) CASING-BASED INTELLIGENT COMPLETION ASSEMBLY

(71) Applicant: HALLIBURTON ENERGY SERVICES, INC., Houston, TX (US)

(72) Inventors: Savio Saldanha, Spring, TX (US); Matthew Scogin, Montgomery, TX (US); Timothy R. Tips, Montgomery, TX (US); Colin McKay, Houston, TX (US); Michael Konopczynski, Spring, TX (US); James Flygare, Humble, TX (US); Robert Smith, Magnolia, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 1 day.

(21) Appl. No.: 15/550,620

(22) PCT Filed: Apr. 30, 2015

(86) PCT No.: PCT/US2015/028475
§ 371 (c)(1),
(2) Date: Aug. 11, 2017

(87) PCT Pub. No.: WO2016/175827
PCT Pub. Date: Nov. 3, 2016

(65) Prior Publication Data

US 2018/0030810 A1 Feb. 1, 2018

(51) Int. Cl.
*E21B 34/06* (2006.01)
*E21B 43/12* (2006.01)
(Continued)

(52) U.S. Cl.
CPC ..... *E21B 34/06* (2013.01); *E21B 43/12* (2013.01); *E21B 43/08* (2013.01)

(58) Field of Classification Search
CPC ..... E21B 34/06; E21B 43/12
See application file for complete search history.

(56) References Cited

U.S. PATENT DOCUMENTS 4,196,781 A 4/1980 Cheek
4,583,804 A 4/1986 Thompson
(Continued)

FOREIGN PATENT DOCUMENTS

CN 103244075 8/2013

OTHER PUBLICATIONS

International Search Report and Written Opinion for International Application No. PCT/US2015/028475 dated Jan. 5, 2016. (14 pages).

(Continued)

*Primary Examiner* — Robert E Fuller
*Assistant Examiner* — Lamia Quaim
(74) *Attorney, Agent, or Firm* — Haynes and Boone, LLP

(57) ABSTRACT

A downhole control method for use in a wellbore that includes deploying a first stand-alone hydraulic reservoir downhole; measuring a first downhole fluid parameter; and actuating a first inflow control device, based on the first measured downhole fluid parameter, using the first stand-alone hydraulic reservoir. In one aspect, the first stand-alone hydraulic reservoir and the first inflow control device comprise an open-hole completion system.

18 Claims, 14 Drawing Sheets

(51) Int. Cl.
*E21B 47/12* (2012.01)
*E21B 43/08* (2006.01)

(56) References Cited

U.S. PATENT DOCUMENTS

| | | | | |
|---|---|---|---|---|
| 5,343,949 | A | 9/1994 | Ross et al. | |
| 5,462,120 | A | 10/1995 | Gondouin | |
| 5,706,892 | A | 1/1998 | Aeschbacher, Jr. et al. | |
| 5,955,666 | A | 9/1999 | Mullins | |
| 6,179,052 | B1 | 1/2001 | Purkis et al. | |
| 6,360,820 | B1 | 3/2002 | Laborde et al. | |
| 6,464,011 | B2 | 10/2002 | Tubel | |
| 6,513,599 | B1 | 2/2003 | Bixenman et al. | |
| 6,568,469 | B2 | 5/2003 | Ohmer et al. | |
| 6,633,236 | B2 | 10/2003 | Vinegar et al. | |
| 6,830,106 | B2 | 12/2004 | Cavender | |
| 6,851,481 | B2 * | 2/2005 | Vinegar | E21B 17/003 166/374 |
| 6,868,040 | B2 | 3/2005 | Vinegar et al. | |
| 6,899,178 | B2 | 5/2005 | Tubel | |
| 7,055,592 | B2 | 6/2006 | Bass et al. | |
| 7,147,059 | B2 | 12/2006 | Hirsch et al. | |
| 7,210,856 | B2 | 5/2007 | Ringgenber | |
| 7,222,676 | B2 | 5/2007 | Patel et al. | |
| 7,257,050 | B2 | 8/2007 | Stewart et al. | |
| 7,387,165 | B2 | 6/2008 | Lopez de Cardenas et al. | |
| 7,392,839 | B1 | 7/2008 | Wintill et al. | |
| 7,735,555 | B2 | 6/2010 | Patel et al. | |
| 7,866,414 | B2 | 1/2011 | Patel | |
| 8,237,585 | B2 | 8/2012 | Zimmerman | |
| 8,330,617 | B2 | 12/2012 | Chen et al. | |
| 8,720,553 | B2 | 5/2014 | Tips et al. | |
| 8,746,337 | B2 | 6/2014 | Grigsby et al. | |
| 8,763,687 | B2 | 7/2014 | Ingram et al. | |
| 8,789,587 | B2 | 7/2014 | Tubel et al. | |
| 8,839,850 | B2 | 9/2014 | Algeroy et al. | |
| 2003/0051881 | A1 | 3/2003 | Vinegar et al. | |
| 2005/0121253 | A1 | 6/2005 | Stewart | |
| 2006/0021797 | A1 | 2/2006 | Krueger | |
| 2009/0045975 | A1 | 2/2009 | Evans et al. | |
| 2009/0050373 | A1 | 2/2009 | Loretz | |
| 2010/0236774 | A1 | 9/2010 | Patel et al. | |
| 2011/0192596 | A1 | 8/2011 | Patel | |
| 2012/0067567 | A1 | 3/2012 | Rytlewski et al. | |
| 2012/0325484 | A1 | 12/2012 | Patel | |
| 2013/0008648 | A1 | 1/2013 | Lovorn et al. | |
| 2013/0213666 | A1 | 8/2013 | Shaw | |
| 2014/0083691 | A1 | 3/2014 | Tips et al. | |
| 2014/0090734 | A1 | 4/2014 | Kusko et al. | |
| 2014/0151066 | A1 | 6/2014 | Reid | |
| 2014/0174714 | A1 * | 6/2014 | Patel | E21B 17/028 166/65.1 |
| 2014/0209327 | A1 * | 7/2014 | Patel | E21B 43/12 166/387 |
| 2014/0231074 | A1 | 8/2014 | Adil et al. | |
| 2016/0312579 | A1 * | 10/2016 | Green | E21B 34/10 |

OTHER PUBLICATIONS

International Search Report and Written Opinion issued by the Korean Intellectual Property Office regarding International Application No. PCT/US2015/028488, dated Jan. 5, 2016, 13 pages.

Editors, *Schlumberger and CNOOC Install World's First Intelligent Completion in a Sophisticated Multilateral Well in South Java Sea,* Business Wire, Nov. 5, 2002, 1 page.

Editors, *To manage or exclude, and what exclusion method, are two key decisions,* World Oil 226.9: Sep. 2005, SS2(4), 5 pages.

Ajayi et al., *Surface Control System Design for Remote Wireless Operations of Intelligent Well Completion System: Case Study* (SPE-121710), 71st EAGE Conference & Exhibition, Jun. 8, 2009, 11 pages.

Non Final Office Action issued by the USPTO regarding U.S. Appl. No. 15/117,897, dated Apr. 3, 2018, 15 pages.

Written Opinion dated Sep. 28, 2018 issued in related Singapore Patent App. No. 11201706737P (53 pages).

Office Action dated Nov. 1, 2018 issued in related U.S. Appl. No. 15/117,897 (21 pages).

Advisory Action dated Dec. 4, 2018 issued in related U.S. Appl. No. 15/117,897 (3 pages).

Written Opinion dated Sep. 13, 2018 issued in Singapore Patent App. No. 11201706438T (7 pages).

* cited by examiner

CASING-BASED INTELLIGENT COMPLETION ASSEMBLY

TECHNICAL FIELD

The present disclosure relates generally to a completion assembly used in an open-hole section of a wellbore, and specifically, to a casing-based intelligent completion assembly.

BACKGROUND

After a well is drilled and a target reservoir has been encountered, completion and production operations are performed. Often, a casing will extend within the wellbore. A lower completion string that includes a plurality of hydraulically actuated valves and corresponding sensors may then be lowered into and positioned within the casing. The casing will generally be perforated to allow formation fluids to enter the casing and flow into the lower completion string via the hydraulically actuated valves. The sensors may monitor downhole fluid parameters, and the hydraulically actuated valves may be activated based on the measured downhole fluid parameters. Generally, a hydraulic system and a power source is located at the surface of the well, from which hydraulic lines and electrical lines extend downhole to the valves and sensors. Thus, often miles of hydraulic lines must be pressurized to actuate each of the valves, which may delay response of the valves and increase expense associated with the completion and production operations. Similarly, miles of electrical lines may be run from the surface to the sensors or to other components of the lower completion string. Additionally, since the lower completion string has an inner diameter that is less than an inner diameter of the casing, the lower completion string limits the flow rate at which the well fluids may flow towards the surface of the well.

BRIEF DESCRIPTION OF THE DRAWINGS

Various embodiments of the present disclosure will be understood more fully from the detailed description given below and from the accompanying drawings of various embodiments of the disclosure. In the drawings, like reference numbers may indicate identical or functionally similar elements.

FIG. 5A illustrates a sectional view of the casing-based intelligent completion assembly of FIG. 1, according to another exemplary embodiment of the present disclosure;

FIG. 10A illustrates a sectional view of the casing-based intelligent completion assembly of FIG. 1, according to yet another exemplary embodiment of the present disclosure;

DETAILED DESCRIPTION

Figure 1:
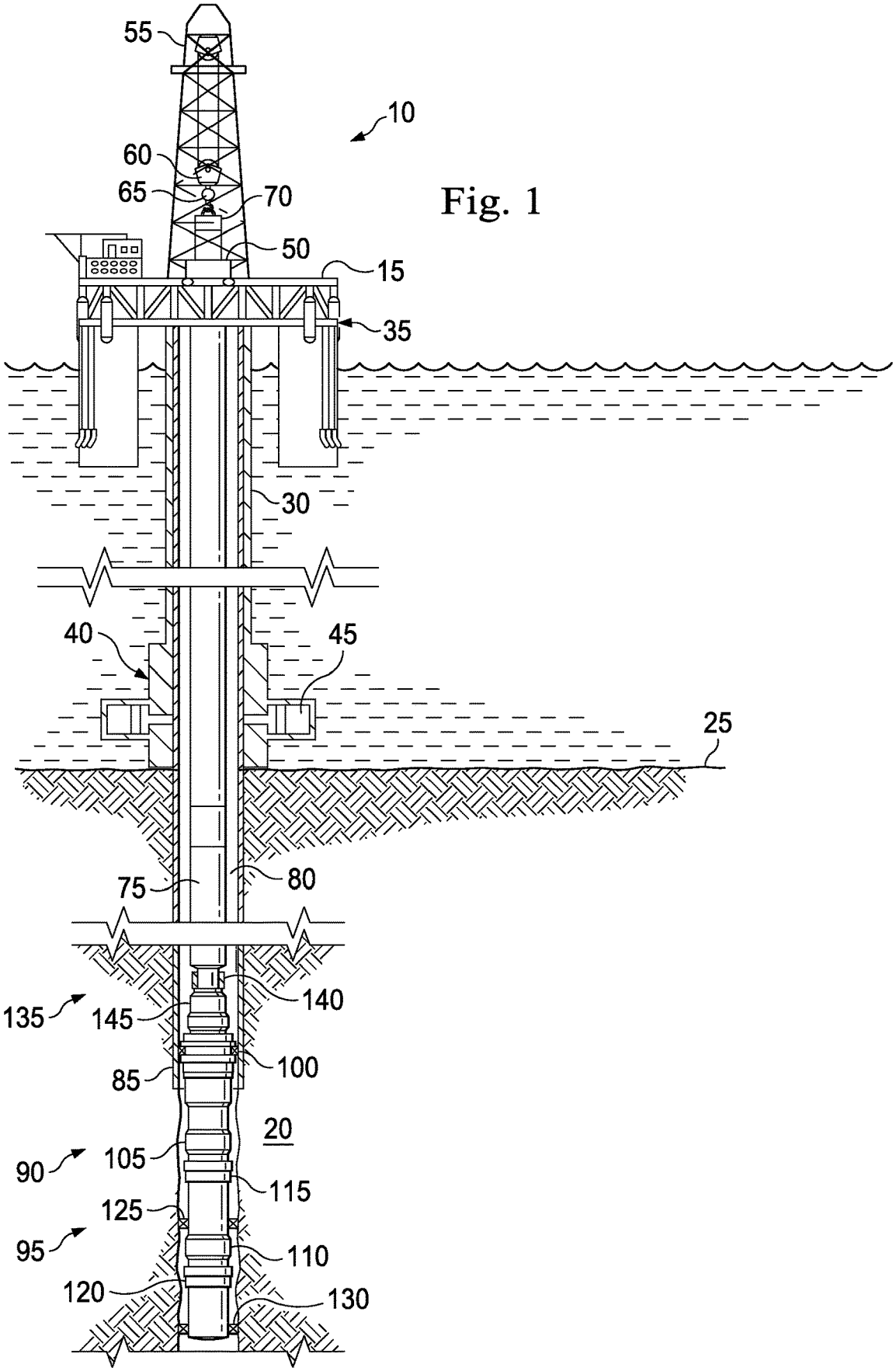
FIG. 1 is a schematic illustration of an offshore oil and gas platform operably coupled to a casing-based intelligent completion assembly, according to an exemplary embodiment of the present disclosure.

Illustrative embodiments and related methods of the present disclosure are described below as they might be employed in a casing-based intelligent completion assembly and method of operating the same. In the interest of clarity, not all features of an actual implementation or method are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure. Further aspects and advantages of the various embodiments and related methods of the disclosure will become apparent from consideration of the following description and drawings.

The foregoing disclosure may repeat reference numerals and/or letters in the various examples. This repetition is for the purpose of simplicity and clarity and does not in itself dictate a relationship between the various embodiments and/or configurations discussed. Further, spatially relative terms, such as "beneath," "below," "lower," "above," "upper," "uphole," "downhole," "upstream," "downstream," and the like, may be used herein for ease of description to describe one element or feature's relationship to another element(s) or feature(s) as illustrated in the figures. The spatially relative terms are intended to encompass different orientations of the apparatus in use or operation in addition to the orientation depicted in the figures. For example, if the apparatus in the figures is turned over, elements described as being "below" or "beneath" other elements or features would then be oriented "above" the other elements or features. Thus, the exemplary term "below" may encompass both an orientation of above and below. The apparatus may be otherwise oriented (rotated 90 degrees or at other orientations) and the spatially relative descriptors used herein may likewise be interpreted accordingly.

FIG. 1 is a schematic illustration of an offshore oil and gas platform generally designated 10, operably coupled by way of example to a casing-based intelligent completion assembly according to the present disclosure. Such a casing-based intelligent completion assembly could alternatively be coupled to a semi-sub or a drill ship as well. Also, even though FIG. 1 depicts an offshore operation, it should be understood by those skilled in the art that the apparatus according to the present disclosure is equally well suited for use in onshore operations. By way of convention in the following discussion, though FIG. 1 depicts a vertical wellbore, it should be understood by those skilled in the art that the apparatus according to the present disclosure is equally well suited for use in wellbores having other orientations including horizontal wellbores, slanted wellbores, multilateral wellbores or the like. Accordingly, it should be understood by those skilled in the art that the use of directional terms such as "above," "below," "upper," "lower," "upward," "downward," "uphole," "downhole" and the like are used in relation to the illustrative embodiments as they are depicted in the figures, the upward direction being toward the top of the corresponding figure and the downward direction being toward the bottom of the corresponding figure, the uphole direction being toward the surface of the well, the downhole direction being toward the toe of the well.

Referring still to the offshore oil and gas platform example of FIG. 1, a semi-submersible platform 15 may be positioned over a submerged oil and gas formation 20 located below a sea floor 25. A subsea conduit 30 may extend from a deck 35 of the platform 15 to a subsea wellhead installation 40, including blowout preventers 45. The platform 15 may have a hoisting apparatus 50, a derrick 55, a travel block 60, a hook 65, and a swivel 70 for raising and lowering pipe strings, such as a substantially tubular, axially extending production tubing 75.

As in the present example embodiment of FIG. 1, a wellbore 80 extends through the various earth strata including the formation 20, with a portion of the wellbore 80 having a casing string 85 cemented therein. Disposed in the wellbore 80 is a casing-based intelligent completion assembly 90. Generally, the casing-based intelligent completion assembly 90 includes a lower completion assembly 95 that generally includes a hanger 100, sensors 105 and 110, inflow control devices 115 and 120, and packers 125 and 130. The packers 125 and 130 are open-hole packers. The casing-based intelligent completion assembly 90 also includes an upper completion assembly 135 that may include various components such as a joint 140 located on a tubing string 145 that couples to the hanger 100 of the lower completion assembly 95. The upper completion assembly 135 may also include a safety valve (not shown).

Figure 2A:
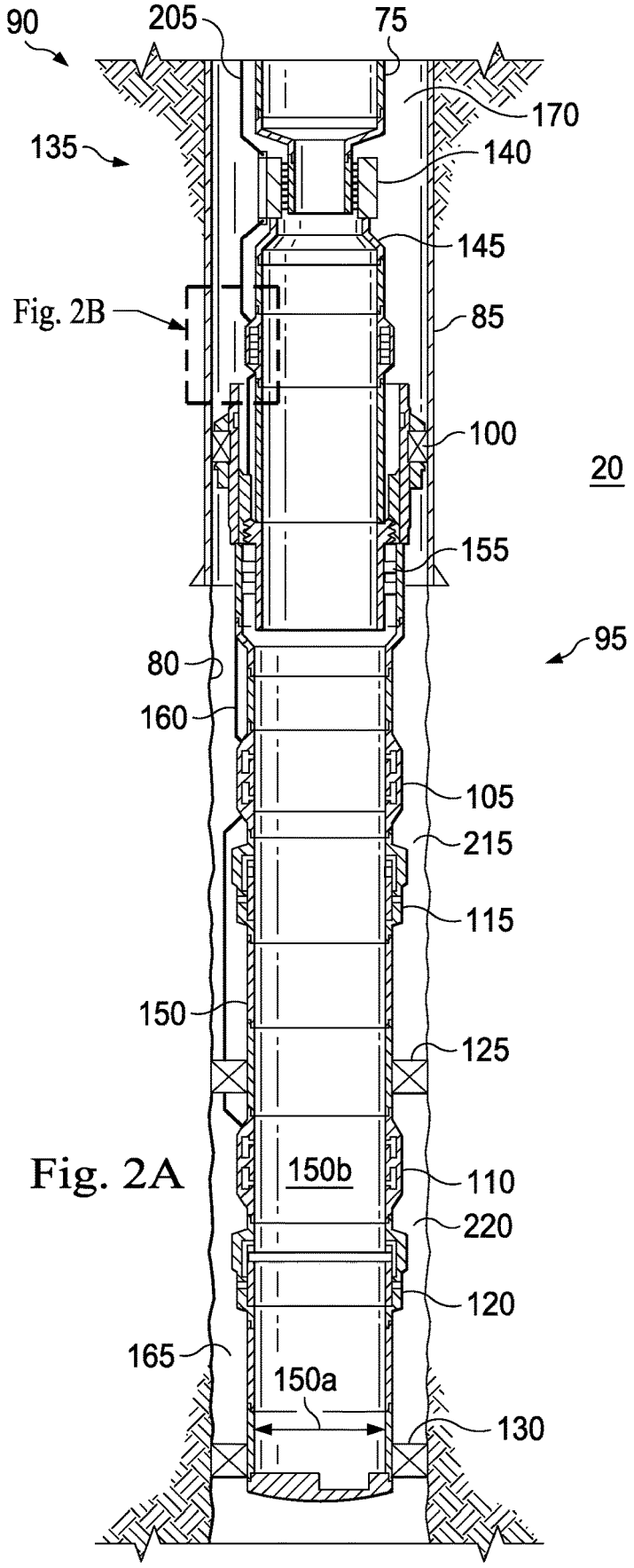
FIG. 2A illustrates a sectional view of the casing-based intelligent completion assembly of FIG. 1, according to an exemplary embodiment of the present disclosure.
Figure 2B:
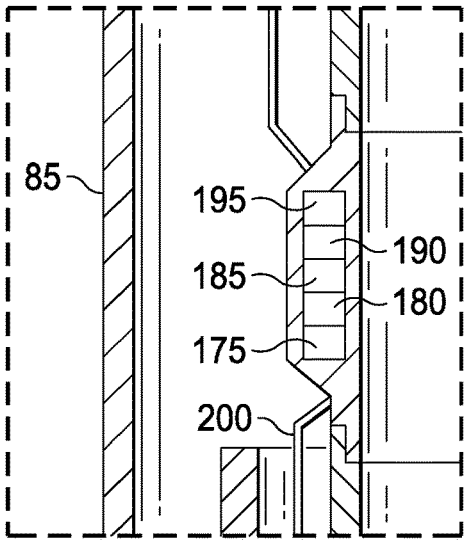
FIG. 2B illustrates an enlarged portion of the casing-based intelligent completion assembly of FIG. 2A, according to an exemplary embodiment of the present disclosure.

FIG. 2A illustrates a sectional view of the casing-based intelligent completion assembly of FIG. 1. FIG. 2B illustrates an enlarged portion of the casing-based intelligent completion assembly of FIG. 2A. Referring together to FIGS. 2A and 2B, the lower completion assembly 95 of the casing-based intelligent completion assembly 90 includes an elongated based pipe, or liner 150 having annular sealing elements, or the packers 125 and 130, axially spaced along the liner 150. The lower completion assembly 95 also includes a coupler 155 that is positioned near the top of the liner 150. The coupler 155 may be any one of a disconnect tool, an induction coupler, an acoustic coupler, or similar device. The coupler 155 is an electrical and hydraulic interface between the upper completion assembly 135 and the lower completion assembly 95. The coupler 155 detachably couples to the upper completion assembly 135. A control line 160 extends from the coupler 155 to the sensors 105 and 110 within an annulus 165, which is formed between the liner 150 and the formation 20. As shown, the control line 160 is attached to an exterior surface of the liner 150. However, the control line 160 may form a portion of the liner 150. The liner 150 may be referred to as a casing, but the liner 150 is generally not cemented to the wellbore as is the cemented casing 85.

The liner 150 is a nominally seven-inch (177.8 mm) liner, but may be a liner of any size. The liner 150 has an inner surface that forms an inner diameter 150*a*. The liner 150 also forms a fluid flow passage 150*b* for moving well or formation fluids that flow from the formation 20 towards the surface of the well.

The inflow control devices 115 and 120 are interval control valves that form an orifice in the liner 150 and restrict flow of the well fluid from the formation 20 into the liner 150. The inflow control devices 115 and 120 form a portion of the fluid flow passage 150*h* have an inner diameter that is the same as, or substantially similar to (tolerance of 10%) the inner diameter 150*a* of the liner 150. Thus, the inflow control devices 115 and 120 are "integrated" into the liner 150 with a portion of each located on an external surface of the liner 150.

The sensors 105 and 110 may be electronic gauge systems, with the sensor 105 being coupled to and/or in communication with the control valve 115 and the sensor 110 being coupled to and/or in communication with the control valve 120. Generally, the sensors 105 and 110 are fluid testing devices, which analyzes the fluid flowing through the annulus 165. The sensors 105 and 110 may be a flow meter, water cut meter, or similar device. However, the sensors 105 and 110 may be any sensor that measures a fluid parameter along an external surface of the liner 150.

The hanger 100 may be an expandable liner hanger or modified liner hanger that suspends at least a portion of the lower completion assembly 95 within an open-hole section of the wellbore 80. The hanger 100 may be located downhole near an interface between the open-hole section of the wellbore 80 and a cased portion of the wellbore 80, which is defined by the cemented casing 85. The hanger 100 may also fluidically isolate the annulus 165 from an annulus 170 between the production tubing 75 and the cemented casing 85.

The upper completion assembly 135 may include the joint 140, the tubing string 145, a pump 175 that is coupled to the tubing string 145, a motor 180 that is coupled to the tubing string 145, an accumulator 185 that is coupled to the tubing string 145, a controller 190 that is coupled to the tubing string 145, a communication device 195 that is coupled to the tubing string 145, and a control line 200. The pump 175, the motor 180, the accumulator 185, the controller 190, and the communication device 195 are housed in one enclosure and may be mounted on the outer diameter of the tubing string 145. The upper completion assembly 135 may also include a plurality of hydraulic manifolds (not shown). The control line 200 is in communication with the controller 190, the pump 175, the motor 180, and/or the accumulator 185. The controller 190 is in communication with the motor 180, which actuates the pump 175 so that hydraulic fluid contained within the accumulator 185 is moved through the control line 200.

The packer 125 is an open-hole packer that allows the control line 160 to bypass the packer 125 before, during, and after it has been set or actuated. As shown in FIG. 2A, after the packers 125 and 130 are set, a first production zone 215 of the annulus 165 is fluidically isolated from a second production zone 220 of the annulus 165.

One or more communication cables such as a control line 205 may be provided and extend from the controller 190 of the upper completion assembly 135 to the surface in the annulus 170. However, the control line 205 may be a single electrical line that connects the controller 190 to the interface card or that powers the casing-based intelligent completion assembly 90.

Figure 3:
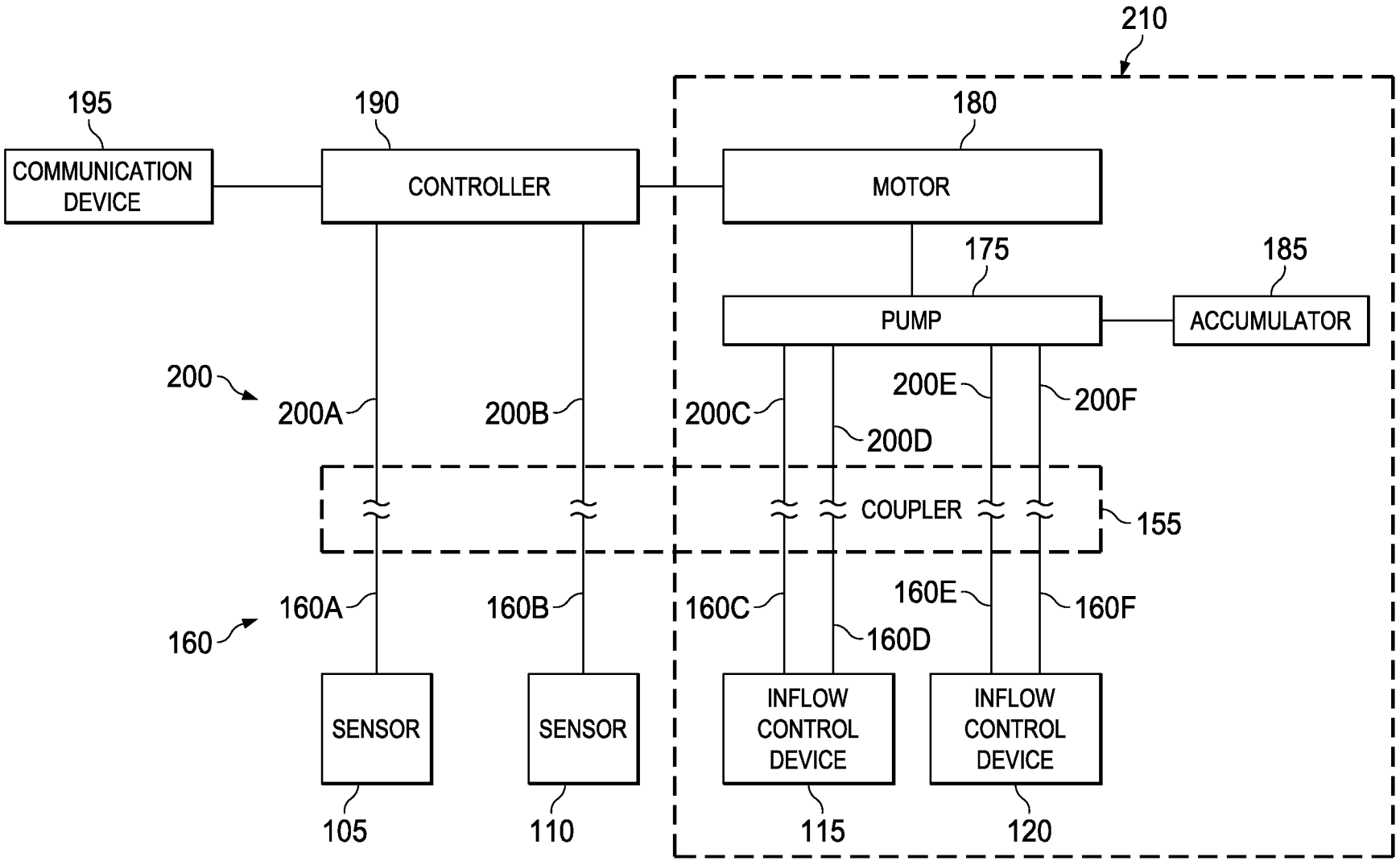
FIG. 3 illustrates a diagrammatic view of a portion of the casing-based intelligent completion assembly of FIG. 2A, according to an exemplary embodiment of the present disclosure.

FIG. 3 is a diagrammatic view of a portion of the casing-based intelligent completion assembly of FIG. 2A. The control line 160, as shown in FIG. 3, includes an electrical line 160*a* extending from the coupler 155 to the sensor 105, an electrical line 160*b* extending from the coupler 155 to the sensor 110, hydraulic lines 160*c* and 160*d* extending from the coupler 155 to the inflow control device 115, and hydraulic lines 160*e* and 160*f* extending from the coupler 155 to the inflow control device 120. The control line 160 may be multi-dropped from the sensor 105 to the sensor 110, to the inflow control device 115, and to the inflow control device 120. The control line 160 facilitates the monitoring and control of the sensors 105 and 110 and the inflow control devices 115 and 120. The control line 160 may include hydraulic control lines that carry hydraulic fluid under pressure and electric line or I-wire that provides electrical power and communication, or the control line 160 may be a single conductor or a multiple conductor. The control line 160 is in communication with the coupler 155, the inflow control devices 115 and 120, and the sensors 105 and 110 to fluidically and or hydraulically couple the coupler 155 with the inflow control devices 115 and 120 and to place the coupler 155 in communication with the sensors 105 and 110. The control line 200 includes a plurality of lines, such as electric lines or I-wires 200*a* and 200*b* that provide electrical power and communication and hydraulic lines 200*c*, 200*d*, 200*e*, and 200*f* that carry hydraulic fluid under pressure. The control line 200 couples to the coupler 155 to hydraulically couple the hydraulic line 200*c* with the coupler 155 and/or with the hydraulic line 160*c*; to couple the hydraulic line 200*d* with the coupler 155 and/or with the hydraulic line 160*d*; to couple the hydraulic line 200*e* with the coupler 155 and/or with the hydraulic line 160*e*; to couple the hydraulic line 210*f* with the coupler 155 and/or with the hydraulic line 160*f*; to place the electrical line 200*a* in communication with the coupler 155 and/or the electrical line 160*a*; and to place the electrical line 200*b* in communication with the coupler and/or the electrical line 160*b*. Thus, the pump 175 may move the hydraulic fluid in a direction away from the accumulator 185 and towards the coupler 155 through any one of the hydraulic lines 200*c*, 200*d*, 200*e*, 200*f*, 160*c*, 160*d*, 160*e*, and 160*f* to actuate the inflow control device 115 and/or the inflow control device 120. Additionally, the controller 190 may actuate the motor 180 and/or the pump 175 such that the hydraulic fluid within any one of the hydraulic lines 200*c*, 200*d*, 200*e*, 200*f*, 160*c*, 160*d*, 160*e*, and 160*f* may be "bled off" into the accumulator 185. The communication device 195 is in communication with the controller 190 and communicates with other down hole tools, additional sensors, and/or a surface system (not shown) that is located at the surface of the well. The communication device 195 may be a wired pipe network that permits one way or bi-directional communication with the surface system. The sensors 105 and 110 are in communication with the controller 190 and are capable of sending data to the controller 190, which is capable of actuating each of the inflow control devices 115 and 120. The controller 190 transfers data and communicates with the interface card through a subsea hanger (not shown), such as through the communication device 195. The accumulator 185 is sized such that the accumulator 185 ensures sufficient hydraulic force is available to move the inflow control devices 115 and 120.

The casing-based intelligent completion assembly 90 includes a downhole closed-loop hydraulic system 210. The hydraulic system 210 is, or may include, a stand-alone hydraulic reservoir. The hydraulic system 210 may include the pump 175, the accumulator 185, the pump 180, the control lines 200 and 160, the coupler 155, and the inflow control devices 115 and 120. The stand-alone hydraulic reservoir is any closed system for containing the hydraulic fluid, which can include tubing and passageways as well as a vessel connected thereto. For example, the stand-alone hydraulic reservoir may be the pump 185, the accumulator 185, the control lines 200 and 160, the coupler 155, and the control devices 115 and 120. The stand-alone hydraulic system has no hydraulic lines running directly or indirectly to the surface. As such, the hydraulic system 210 is fluidically isolated from other fluids within the wellbore 80, such that the hydraulic fluid is contained within the hydraulic system 210 to allow for repetitive or continuous operation of the inflow control devices 115 and 120. The hydraulic system 210 is remote from any hydraulic system located on the surface of the well. That is, no hydraulic lines extend from the surface of the well and to the hydraulic system 210. Therefore, the hydraulic system 210 is fluidically isolated from any hydraulic systems located at the surface of the well. The hydraulic system 210 is a self-contained hydraulic system.

Figure 4:
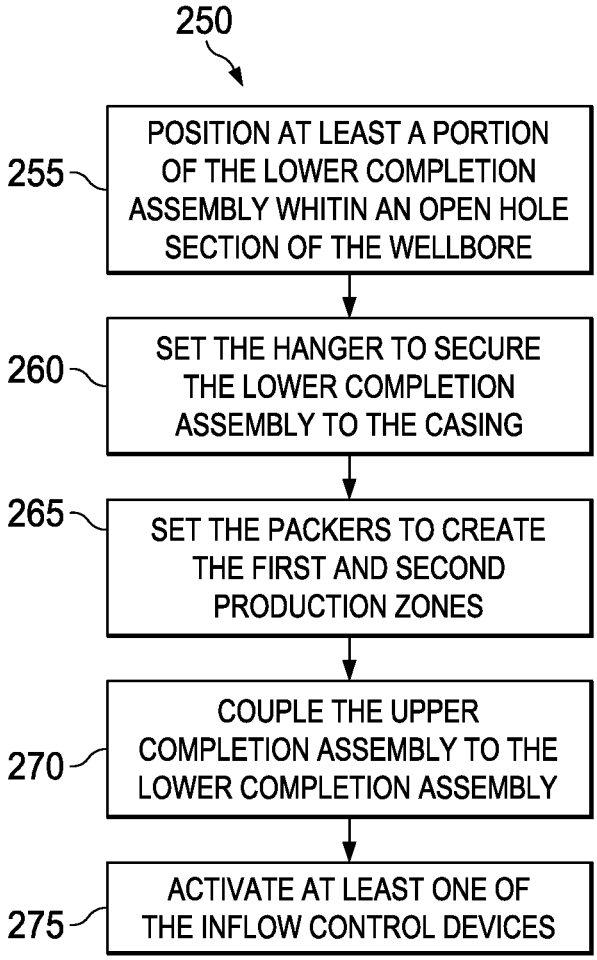
FIG. 4 is a flow chart illustration of a method of operating the assembly of FIG. 2A, according to an exemplary embodiment.

FIG. 4 is a flow chart illustration of a method 250 of operating the assembly of FIG. 2A and includes positioning at least a portion of the lower completion assembly 95 within an open-hole section of the wellbore 80 at step 255; setting the hanger 100 to secure the lower completion assembly 95 to the cemented casing 85 at step 260; setting the packers 125 and 130 to create the first production zone 215 and the second production zone 220 at step 265; coupling the upper completion assembly 135 to the lower completion assembly 95 at step 270; and activating at least one of the inflow control devices 115 and 120 at step 275.

At least a portion of the lower completion assembly 95 is extended within an open-hole section of the wellbore 80 at the step 255. A running tool (not shown) is coupled to the lower completion assembly 95 to lower the lower completion assembly 95 within the wellbore 80 such that at least a portion of the lower completion assembly 95 extends within an open-hole section of the wellbore 80. Extending the lower completion assembly 95 within the open-hole section of the wellbore 80 creates the annulus 165, which is formed between the liner 150 and the formation 20. During the step 255, the packers 125 and 130 and the hanger 100 are not in the "set" position, thus the lower completion assembly 95 is capable of moving relative to the wellbore 80. Generally, the inflow control devices 115 and 120 are in a closed position while the lower completion assembly 95 is lowered downhole.

The hanger 100 is set to secure the lower completion assembly 95 to the cemented casing 85 at the step 260. In one exemplary embodiments, once the hanger 100 is activated or set, the hanger 100 suspends the lower completion assembly 95 within the open-hole section of the wellbore 80.

The packers 125 and 130 are set at the step 265 to fluidically isolate the first production zone 215 from the second production zone 220 while maintaining hydraulic communication between the first zone 215 and the second zone 220 of the open-hole section of the wellbore.

The upper completion assembly 135 is coupled to the lower completion assembly 95 at the step 270. The upper completion assembly 135, which is coupled to the production tubing 75, is lowered downhole until the upper completion assembly 135 couples with the lower completion assembly 95. Specifically, the control line 200 couples to the coupler 155 to hydraulically couple the hydraulic line 200*c* with the coupler 155 and/or with the hydraulic line 160*c*; to hydraulically couple the hydraulic line 200*d* with the coupler 155 and/or with the hydraulic line 160*d*; to hydraulically couple the hydraulic line 200*e* with the coupler 155 and/or with the hydraulic line 160*e*; to hydraulically couple the hydraulic line 210*f* with the coupler 155 and/or with the hydraulic line 160*f*; to place the electrical line 200*a* in communication with the coupler 155 and/or the electrical line 160*a*; and to place the electrical line 200*b* in communication with the coupler and/or the electrical line 160*b*. As the upper completion assembly 135 is coupled to the lower completion assembly 95, the downhole closed-loop hydraulic system is deployed at the step 270.

Any one of more of the inflow control devices 115 and 120 are activated at the step 275. The inflow control devices 115 and 120 are opened or at least partially opened to allow for the well fluid to enter the flow passage 150*b* from the formation 20. The sensor 105 measures a first fluid parameter condition within the annulus 165 of the first production zone 215. Data relating to the first fluid parameter condition is then transmitted to the controller 190 via the control line 160*a*, the coupler 155, and the control line 200*a*. Based on the data relating to the first fluid parameter, the controller 190 activates the motor 180 and/or the pump 175 such that the pump 175 moves a portion of the hydraulic fluid in a direction away from the accumulator 185 and towards the inflow control device 115 using either the control lines 200*c* and 160*c* or 200*d* and 160*d*. Thus, the inflow control device 115 may be hydraulically actuated towards an open position or a closed position. Additionally, the sensor 110 measures a second fluid parameter condition within the annulus 165 of the second production zone 220. Data relating to the second fluid parameter condition is then transmitted to the controller 190 via the control line 160*b*, the coupler 155, and the control line 200*b*. Based on the data relating to the second fluid parameter, the controller 190 activates the motor 180 and/or the pump 175 such that the pump 175 moves a portion of the hydraulic fluid in a direction away from the accumulator 185 and towards the inflow control device 120 using either the control lines 200*e* and 160*e* or 200*f* and 160*f*. Thus, the inflow control device 120 may be hydraulically actuated towards an open position or a closed position. The downhole closed-loop hydraulic system 210 selectively controls each of the inflow control devices 115 and 120 based on information or data sent from the sensors 105 and 110 to the controller 190 via the control lines 160 and 200. Thus, the casing-based intelligent completion assembly 90, which includes the downhole closed-loop hydraulic system 210, monitors and controls reservoir intervals selectively.

The upper completion assembly 135 may also be disconnected from the lower completion assembly 95 to remove the upper completion assembly 135 from within the wellbore 80. Thus, the upper completion assembly 135 may be replaced or repaired and then reconnected with the lower completion assembly 95.

Figure 5B:
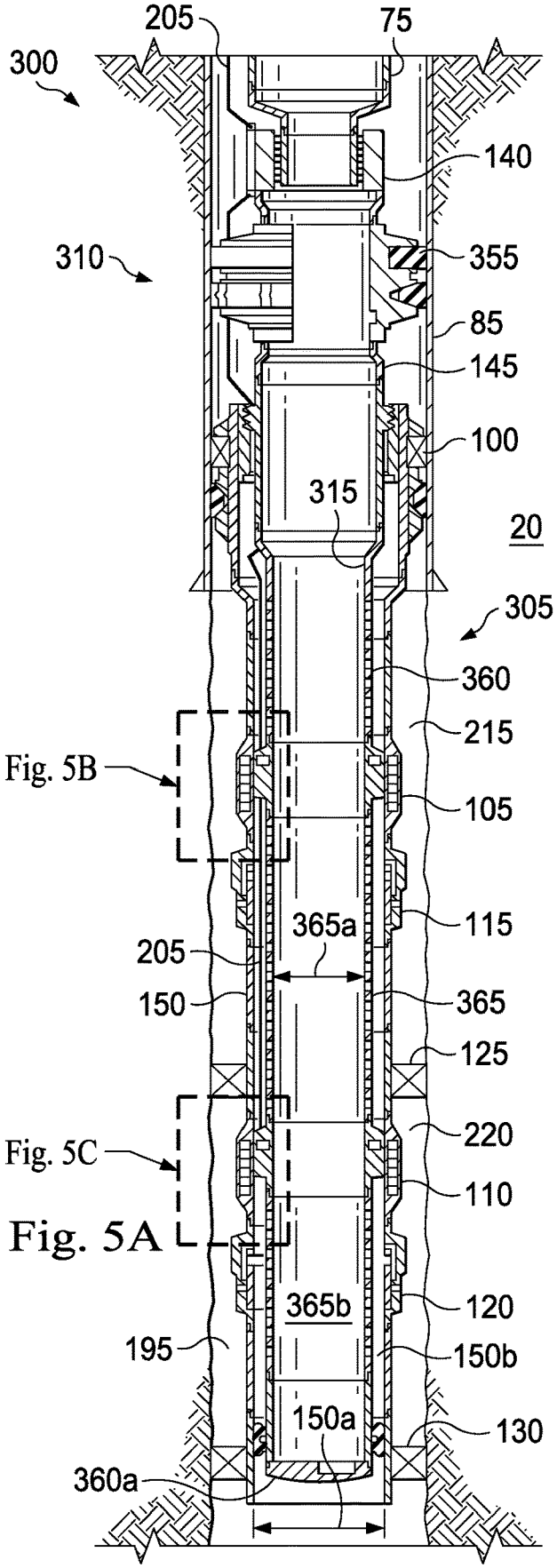
FIG. 5B illustrates an enlarged portion of the casing-based intelligent completion assembly of FIG. 5A, according to an exemplary embodiment of the present disclosure.
Figure 5B:
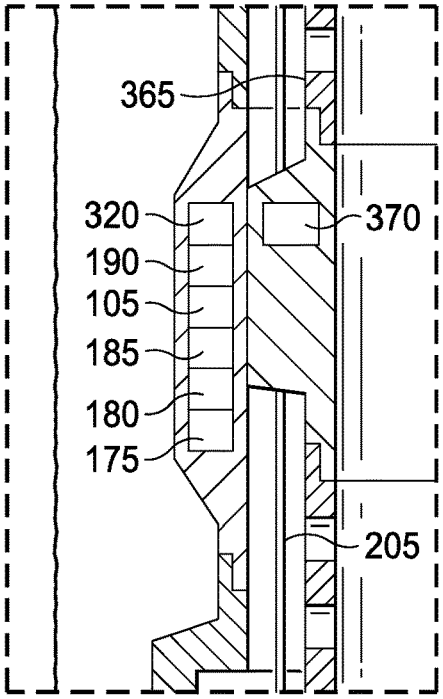
Figure 5C:
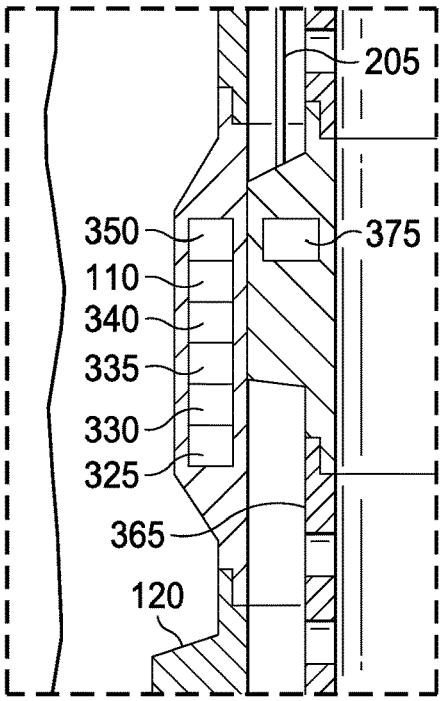
FIG. 5C illustrates another enlarged portion of the casing-based intelligent completion assembly of FIG. 5A, according to an exemplary embodiment of the present disclosure.
Figure 6:
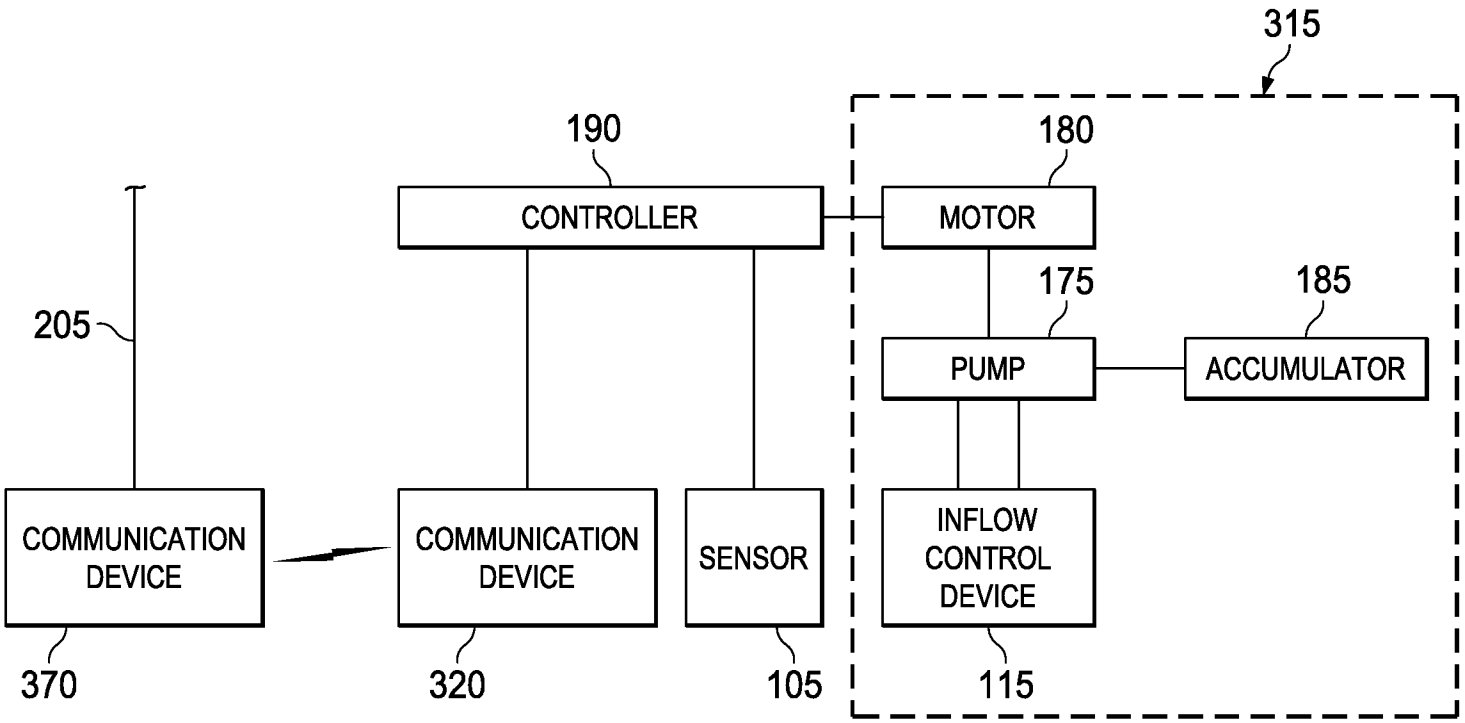
FIG. 6 illustrates a diagrammatic view of a portion of the casing-based intelligent completion assembly of FIG. 5A, according to an exemplary embodiment of the present disclosure.

An alternative embodiment of the casing-based intelligent completion assembly 90 is a casing-based intelligent completion assembly 300. FIG. 5A illustrates a sectional view of the casing-based intelligent completion assembly 300. FIG. 5B illustrates an enlarged portion of the casing-based intelligent completion assembly 300. FIG. 5C illustrates another enlarged portion of the casing-based intelligent completion assembly 300. FIG. 6 illustrates a diagrammatic view of a portion of the casing-based intelligent completion assembly 300. Generally, the casing-based intelligent completion assembly 300 is similar to the casing-based intelligent completion assembly 90 and includes a lower completion assembly 305 that couples to an upper completion assembly 310. As illustrated in FIGS. 5A, 5B, 5C, and/or 6, the lower completion assembly 305 generally includes the liner 150 having the packers 125 and 130 axially spaced apart along the liner 150. The lower completion assembly 305 also includes the hanger 100, the inflow control devices 115 and 120, and the sensors 105 and 110. However, the lower completion assembly 305 does not include the coupler 155. Instead, the lower completion assembly 305 includes the controller 190, the motor 180, the pump 175, and the accumulator 185. The controller 190, the motor 180, the pump 175, and the accumulator 185 are located on, or form a portion of, the liner 150 and are associated with the sensor 105. The sensor 105 is in communication with the controller 190, and the inflow control device 115 is hydraulically coupled to the pump 175 and/or the accumulator 185. The inflow control device 115, the motor 180, the pump 175, and the accumulator 185 form a downhole closed-loop hydraulic system 315. The lower completion assembly 305 also includes a first communication device 320 that is in communication with the controller 190 and that is located on, or forms a portion of, the liner 150. The first communication device 320 receives and or transmits data and or a signal, such as for example, receive an electrical signal.

Additionally, the lower completion assembly 305 also includes a pump 325, a motor 330, an accumulator 335, and a controller 340, all of which are located on, or form a portion of, the liner 150 and are associated with the inflow control device 120. The pump 325, the motor 330, the accumulator 335, and the controller 340 are identical to the pump 175, the motor 180, the accumulator 185, and the controller 190 that are associated with the inflow control device 115 except that the pump 325, the motor 330, the accumulator 335, and the controller 340 are associated with the inflow control device 120. The accumulator 335 may include, or may be, a stand-alone hydraulic reservoir such that the reservoir has no hydraulic lines running directly or indirectly to the surface. The hydraulic fluid contained within the accumulator 335 is also isolated from the hydraulic fluid contained within the accumulator 185. The sensor 110 is in communication with the controller 340 and the inflow control device 120 is fluidically coupled to the pump 325 and/or the accumulator 335. The inflow control device 120, the motor 330, the pump 325, and the accumulator 335 form a downhole closed-loop hydraulic system. The lower completion assembly 305 also includes a second communication device 350 that is in communication with the controller 340 and that is located on, or forms a portion of, the liner 150. The second communication device 350 is identical to the first communication device 320 and receives and or transmits data and or a signal, such as for example, receive an electrical signal.

The upper completion assembly 310 may include various components such as the tubing string 145 and the joint 140. However, the upper completion assembly 310 does not include the controller 190, the motor 180, the pump 175, and the accumulator 185. Instead, the upper completion assembly 310 may include a packer 355, and an insert string 360 that extends away from the packer 355 in the downhole direction and extends within the flow passage 150*b* of the lower completion assembly 305. The insert string 360 includes a perforated tubing 365 having an inner surface that defines an inner diameter 365*a* and a flow passage 365*b*. The upper completion assembly 310 may also include a third communication device 370 and a fourth communication device 375 that is located on, or forms a portion of, the insert string 360. The third communication device 370 receives and or transmits data and or a signal from the first communication device 320, such as for example, transmit an electrical signal. Additionally, the fourth communication device 375 receives and or transmits data and or a signal from the second communication device 350, such as for example, transmit an electrical signal. The third and fourth communication devices 370 and 375 are in communication and are axially spaced along the insert string 360. In one or more exemplary the third and fourth communication devices 370 and 375 are coupled to the control line 205. The third and fourth communication devices 370 and 375 are couplers that are capable of powering and/or transmitting communications to the first and second communication devices 320 and 350, which may also be couplers. Each of the communication devices 320, 350, 370, and 375 communicates with a corresponding communication device and may receive or transmit data or power. Each of the communication devices 320, 350, 370, and 375 communicates with other down hole tools. The communication device 370 electrically couples to the communication device 320 and the communication device 375 electrically couples to the communication device 325.

The hydraulic system 315 is fluidically isolated from other fluids within the wellbore, such that the hydraulic fluid is contained to allow for operation of the operation of the inflow control device 115 for a lengthy period of time. The hydraulic system 315 is isolated from any hydraulic system located on the surface of the well or other hydraulic systems within the lower completion system 95. That is, no hydraulic lines extend from the surface of the well and to the hydraulic system 315. Therefore, the hydraulic system 315 is fluidically isolated from any hydraulic systems located at the surface of the well. The hydraulic system 315 is a self-contained hydraulic system.

The method of operating the assembly 300 is the substantially similar to the method 250 of operating the assembly 90. However, at the step 270, the upper completion assembly 310 does not couple to the coupler 155. Instead, the upper completion assembly 310 is lowered within the wellbore 80 such that the insert string 360 extends within the flow passage 150*b* of the liner 150. Each of the communication devices 320 and 350 align with and couple to its corresponding communication device 370 or 375. The packer 355 is set to secure the relative position of the upper completion string 310 to the cemented casing 85 and secure the position of the insert string 360 relative to the liner 150. The upper completion string 310 may also include a fluted no-go to encourage proper placement of the insert string 360 within the liner 150. In an exemplary embodiment, when the upper completion assembly 310 is coupled to the lower completion assembly 305, each of the sensors 105 and 105 is powered and is capable of receiving and transmitting data from the control line 205.

Additionally and at step 275, data relating to the first fluid parameter condition is not transmitted to the controller 190 via the control line 160*a*, the coupler 155, and the control line 200*a*. Instead, the first fluid parameter condition is transmitted the controller 190 that is located within the lower completion assembly 305. Similarly, the second fluid parameter condition is not transmitted to the controller 190 via the control line 160*b*, the coupler 155, and the control line 200*b*. Instead, the second fluid parameter is transmitted to the controller 340 that is located within the lower completion assembly 305. Additionally, the inflow control device 120 of the assembly 300 is actuated using a hydraulic fluid that is contained within the accumulator 335. That is, each production zone created within the wellbore is associated with a downhole closed-loop hydraulic system that includes a sensor, an inflow control device, a controller, a pump, a motor, an accumulator, and a communication device so that the operation of the downhole closed-loop hydraulic system in one production zone is independent of operation of a downhole closed-loop hydraulic system in another production zone. Additionally and in an exemplary embodiment, each downhole closed-loop hydraulic system is powered by the insert string 360 such that the assembly 300 only requires the single electrical control line 205 that extends to the surface of the well.

The casing-based intelligent completion assemblies 90 and 300 operate without a hydraulic line extending to/from the surface of the well. As the assemblies 90 and 300 include accumulators that are independent from a hydraulic line that extends to the surface of the well, the actuation or activation of the inflow control devices 115 and 120 is independent of a hydraulic system that extends along the production string 75 and is located at the surface of the well. The method 250 results in reduced response time when activating the inflow control devices 115 and 120. The activation of inflow control devices 115 and 120 is less than 10 minutes, less than 5 minutes, less than 3 minutes, or less than 1 minute from when the first fluid parameter condition or the second fluid parameter condition is measured. The fluid flow passage 150*b* having the inner diameter 150*a* results in increased flow of well fluids from the formation 20. The fluid flow passage 360*b* having an inner diameter 360*a* results in increased flow of well fluids from the formation 20. Thus, the flow rate of the well fluids from the formation 20 is increased when using the assembly 90 and/or 300. The inflow control devices 115 and 120 having an inner diameter that is the same as the inner diameter 150*a* of the liner 150 also allows for increased flow of well fluids from the formation 20. The lower completion assemblies 95 and 305 are capable of rotating inside the wellbore 80. Additionally, each of the lower completion assemblies 95 and 305 include a float shoe (not shown) and each are compatible with "wash down" operations or activities. Upper completion assembly 135 may be retrieved from downhole to replace the pump 175 or other component prior to reattaching the upper completion assembly 135 with the lower completion assembly 95. The assemblies 90 and 300 are compatible with, or allow, mechanical actuation (using a shifting tool) of the inflow control devices 115 and 120. As the assemblies 90 and 300 are independent from a hydraulic line that extends to the surface of the well, costs to operate the assemblies 90 and 300 are reduced and the response time for actuation of the inflow control devices 115 and 120 is also reduced.

Figure 7A:
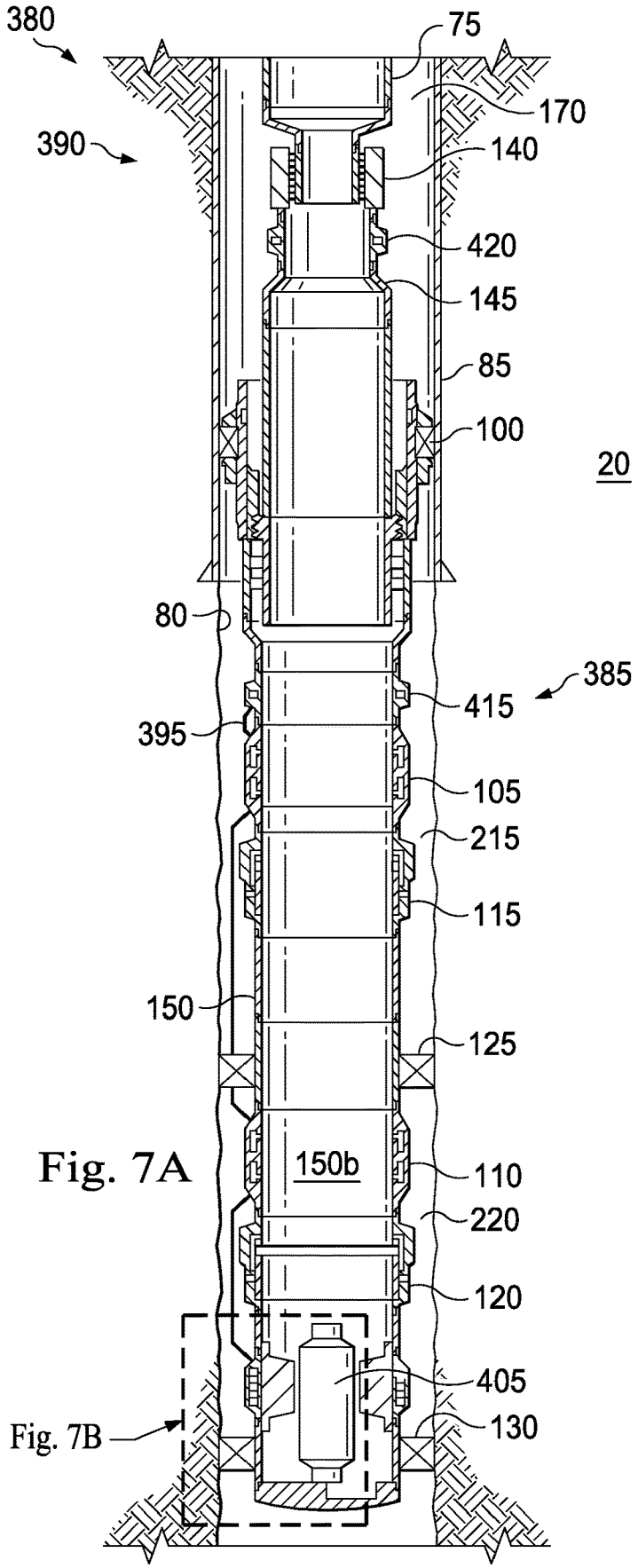
FIG. 7A illustrates a sectional view of the casing-based intelligent completion assembly of FIG. 1, according to yet another exemplary embodiment of the present disclosure.
Figure 7B:
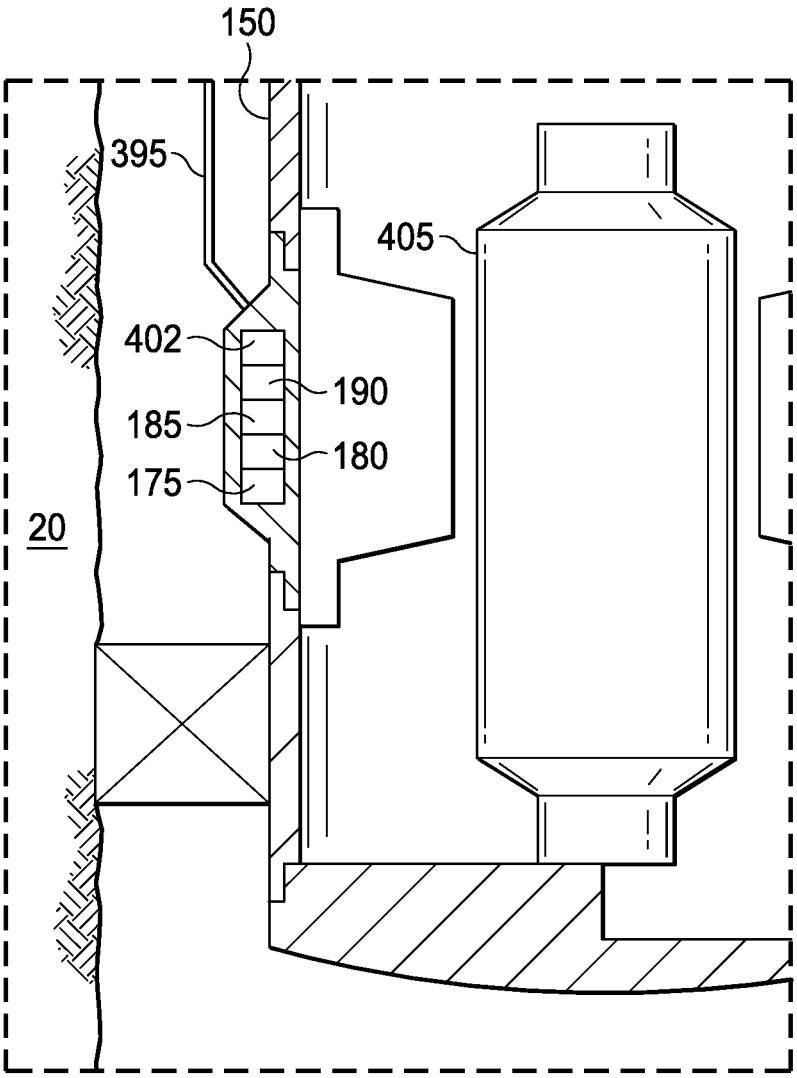
FIG. 7B illustrates an enlarged portion of the casing-based intelligent completion assembly of FIG. 7A, according to an exemplary embodiment of the present disclosure.
Figure 8:
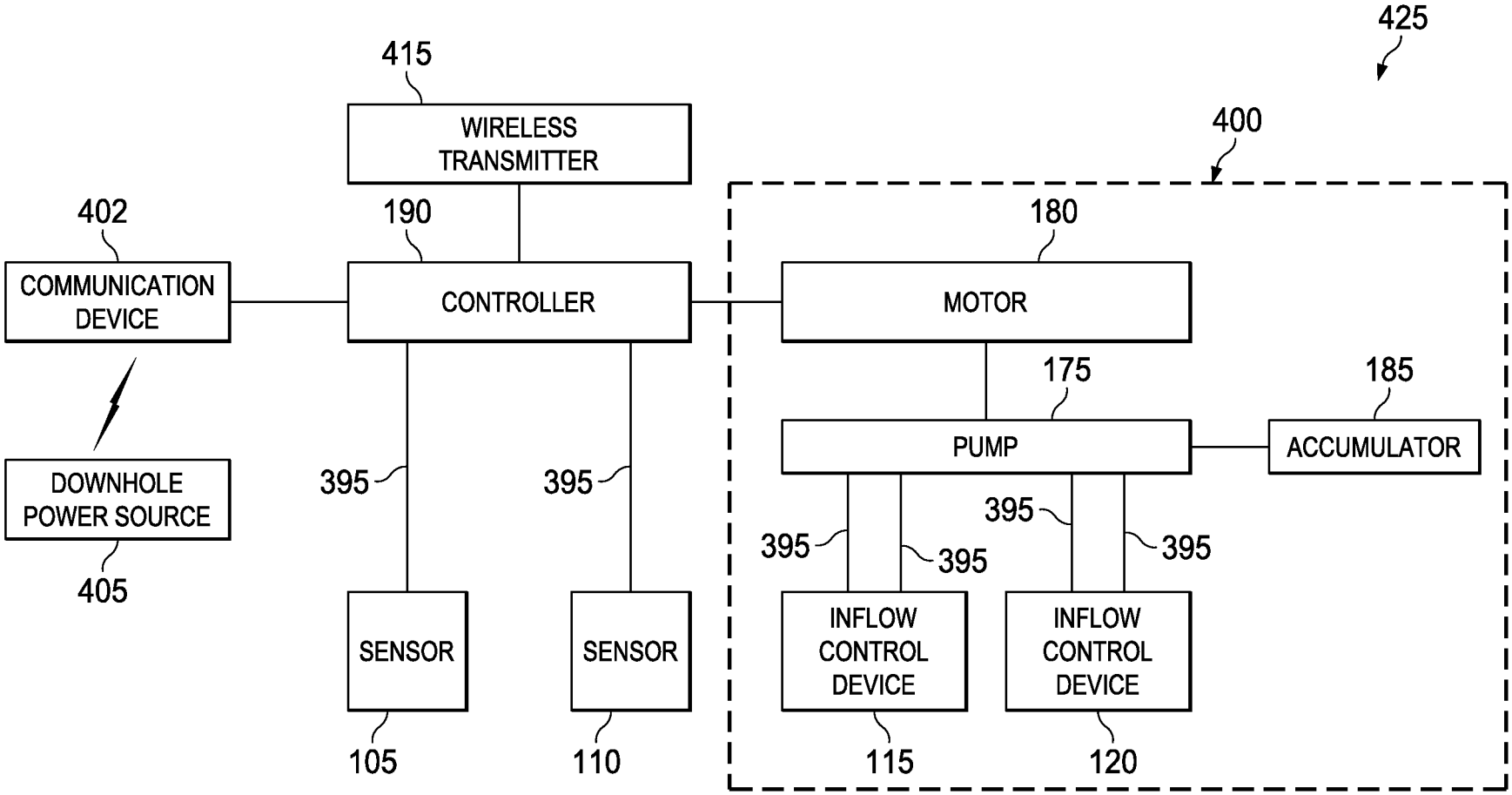
FIG. 8 illustrates a diagrammatic view of a portion of the casing-based intelligent completion assembly of FIG. 7A, according to an exemplary embodiment of the present disclosure.

An alternative embodiment of the casing-based intelligent completion assembly 90 is a remotely-powered casing-based intelligent completion assembly 380. FIG. 7A illustrates a sectional view of the remotely-powered casing-based intelligent completion assembly 380. FIG. 7B illustrates an enlarged portion of the casing-based intelligent completion assembly 380. FIG. 8 illustrates a diagrammatic view of a portion of the casing-based intelligent completion assembly 380. Generally, the remotely-powered casing-based intelligent completion assembly 380 is similar to the casing-based intelligent completion assembly 90 and includes a lower completion assembly 385 that couples to an upper completion assembly 390. As illustrated in FIGS. 7A, 7B, and/or 8, the lower completion assembly 385 generally includes the liner 150 having the packers 125 and 130 axially spaced apart along the liner 150. The lower completion assembly 385 also can include the hanger 100, the inflow control devices 115 and 120, and the sensors 105 and 110. However, the lower completion assembly 385 does not include the coupler 155 and the upper completion assembly 390 does not include the control line 205. Instead, the lower completion assembly 385 includes the controller 190, the motor 180, the pump 175, and the accumulator 185, all of which form a portion of the liner 150. A control line 395 that includes electrical lines or hydraulic lines or both extends from the controller 190 to the sensors 105 and 110 within the annulus 165. The control line 395 also extends from the pump 175 and/or the accumulator 185 to the inflow control devices 115 and 120 within the annulus 165. In an exemplary embodiment, the control line 395 is identical to the control line 160 and is multi-dropped between the sensors 110 and 115, the controller 190, inflow control devices 115 and 120, the pump 175, and/or accumulator 185. Thus, the sensors 105 and 110 are in communication with the controller 190, and the inflow control devices 115 and 120 are hydraulically coupled to the pump 175 and/or the accumulator 185, which form a downhole closed-loop hydraulic system 400. The lower completion assembly 385 also includes a communication device 402, which is located on, or forms a portion of, the liner 150 and is in communication with the controller 190. The communication device 402 receives and or transmits data and or a signal, such as for example, receive an electrical signal. In an exemplary embodiment, the lower completion assembly 385 also includes a stand-alone power source 405. In an exemplary embodiment, the stand-alone power source 405, which may be retrievable from downhole, may be a battery that is capable of transmitting an electrical signal to the controller 190 or otherwise powering the controller 190 to which it is operably coupled. Thus, the stand-alone power source 405 may be replaced if necessary. That is, the stand-alone power source 405 may be placed and retrieved using a running tool or other similarly appropriate tool. The stand-alone power source 405 may be located within the fluid flow passage 150*b* and may be coupled to the liner 150*b* and/or otherwise operably coupled the communication device 402. The stand-alone power source 405 is operably coupled to and powers the controller 190 via the communication device 402. The stand-alone power source 405 may be any downhole power generator, such as a turbine, vibrating crystals, etc. The lower completion assembly 385 also includes a wireless transmitter 415 that is coupled to the control line 395 and that may form a portion of the liner 150. The wireless transmitter 415 is positioned on the liner 150 at a location near the hanger 100.

The upper completion assembly 390 may include various components such as the tubing string 145 and the joint 140. However, the upper completion assembly 390 does not include the controller 190, the motor 180, the pump 175, and the accumulator 185. Instead, the upper completion assembly 390 may include a wireless repeater 420. The wireless repeater 420 wirelessly receives and or transmits data and or a signal, such as for example, transmit an electrical signal. The wireless transmitter 415 and the wireless repeater 420 may be used to wirelessly transmit data between the controller 190 and a system at the surface of the well, as the control line 205 is omitted from the upper completion assembly 390.

Similar to the hydraulic system 210, the hydraulic system 400 is fluidically isolated from other fluids within the wellbore, such that the hydraulic fluid is contained to allow for operation of the operation of the inflow control devices 115 and 120 for a lengthy period of time. The hydraulic system 400 is also isolated from any hydraulic system located on the surface of the well or other hydraulic systems within the lower completion system 380. That is, no hydraulic lines extend from the surface of the well and to the hydraulic system 400. Therefore, the hydraulic system 400 is fluidically isolated from any hydraulic systems located at the surface of the well. The hydraulic system 400 is a self-contained hydraulic system.

The sensors 105 and 110, the controller 190, the motor 180, the pump 175, the accumulator 185, the inflow control devices 115 and 120, the communication device 195, the downhole power device 405, and the wireless transmitter 415 form a downhole casing-based wireless intelligent completion assembly 425. The downhole casing-based wireless intelligent completion assembly 425 may be isolated from any power source or other component that is located on the surface of the well. That is, no electrical lines extend from the surface of the well and to the downhole casing-based wireless intelligent completion assembly 425.

The method of operating the assembly 380 is the substantially similar to the method 250 of operating the assembly 90 shown in FIG. 4. However, at the step 270, the upper completion assembly 390 may couple to the lower completion assembly 395 but not couple to the coupler 155, as the coupler 155 and the control lines 200 and 205 are not required in the assembly 380. Instead, the stand-alone power source 405 can provide power to the lower completion assembly 385 such that the controller 190, the motor 180, the pump 175, the sensors 105 and 110 and any other components that comprise the lower completion assembly 385 are powered without connecting to a power source located at the surface of the well. Communication between a component at the surface of the well, or a downhole tool, and the assembly 380 is transmitted via tubing conveyed repeaters and transmitters, such as for example the wireless repeater 420 and the wireless transmitter 415. Wireless telemetry such as radio modem, electromagnetic wave telemetry, or acoustic is utilized to wirelessly communicate with the assembly 380.

Figure 9A:
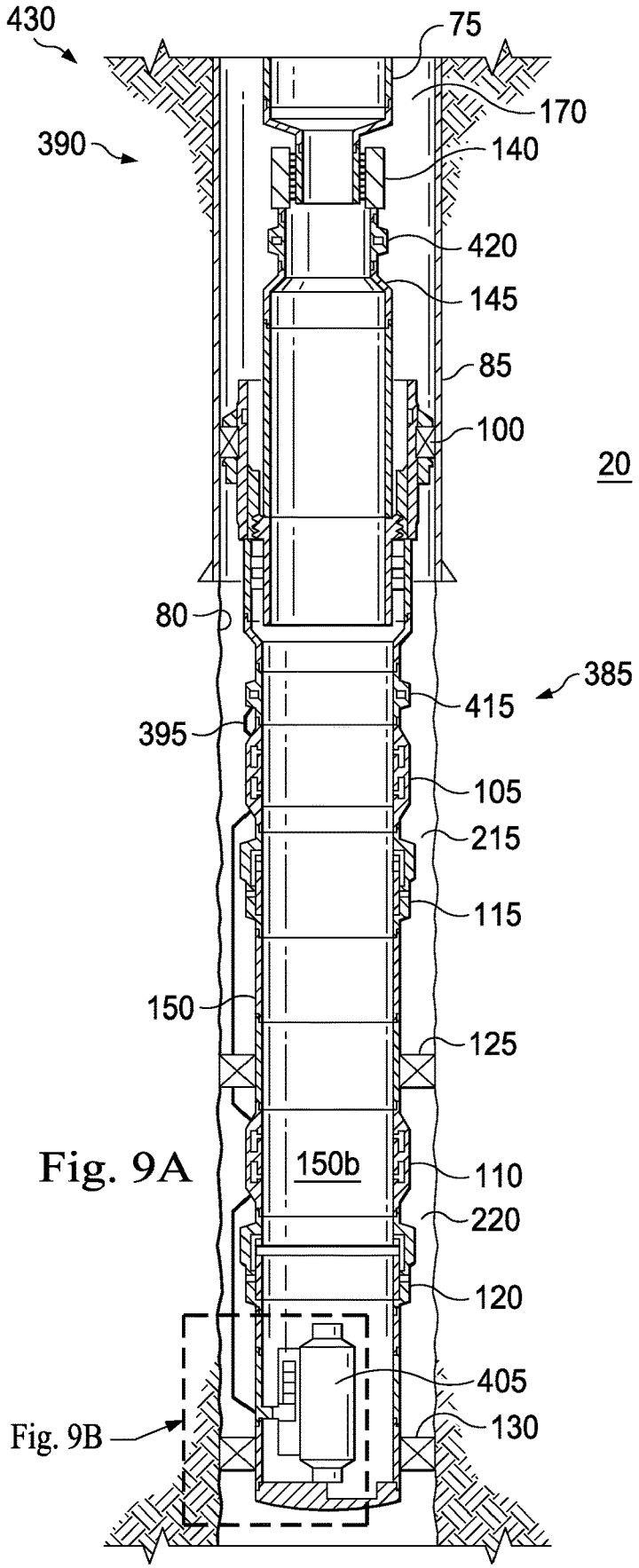
FIG. 9A illustrates a sectional view of the casing-based intelligent completion assembly of FIG. 7A, according to one or more exemplary embodiments of the present disclosure.
Figure 9B:
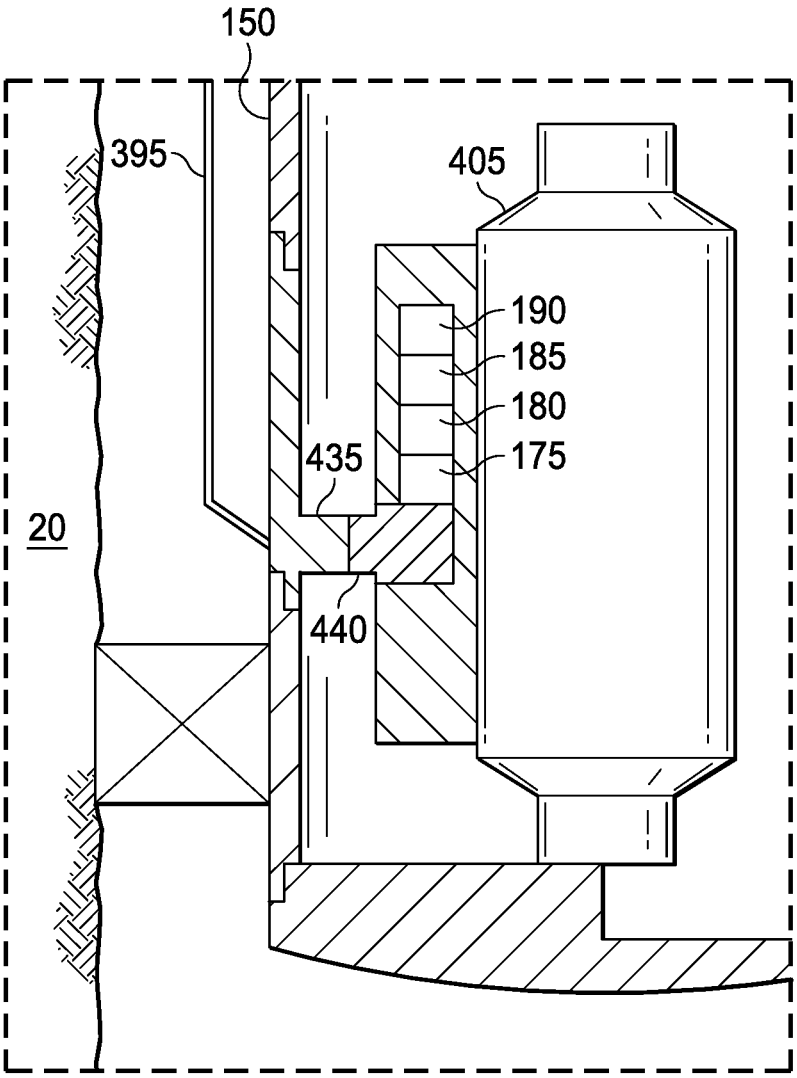
FIG. 9B illustrates an enlarged portion of the casing-based intelligent completion assembly of FIG. 9A, according to exemplary embodiment of the present disclosure.

An alternative embodiment of the casing-based intelligent completion assembly 380 is a remotely-powered casing-based intelligent completion assembly 430. FIG. 9A illustrates a sectional view of the remotely-powered casing-based intelligent completion assembly 430. FIG. 9B illustrates an enlarged portion of the remotely-powered casing-based intelligent completion assembly 430. Generally, the remotely-powered casing-based intelligent completion assembly 430 is similar to the casing-based intelligent completion assembly 380 except that the pump 175, the communication device 402, motor 180, the accumulator 185, and the controller 190 do not form a portion of the liner 150. Instead, as illustrated in FIG. 9B, a coupler 435 forms a portion of the liner 150, while the pump 175, the motor 180, the accumulator 185, the controller 190, and a coupler 440 are attached to the power source 405. The controller 190 may be operably coupled to the power source 405. Additionally, the control line 395 may be in communication with and hydraulically coupled to the coupler 435, which corresponds with the coupler 440 to hydraulically couple the inflow control devices 115 and 120 to the accumulator 185 and/or the pump 175 and to place the sensors 105 and 110 in communication with the controller 190. The power source 405, the pump 175, the motor 180, the accumulator 185, the controller 190, and the coupler 440 may be detached from the coupler 435 and brought to the surface of the well. Thus, any one of the power source 405, the pump 175, the motor 180, the accumulator 185, the controller 190 and/or the coupler 440 may be detached from the liner 150, brought to surface, and be repaired or replaced. The power source 405, the pump 175, the motor 180, the accumulator 185, the controller 190, and the coupler 440 may be attached and detached from the liner 150 using the running tool.

The method of operating the assembly 430 is the substantially similar to the method 250 of operating the assembly 380. At the step 255, when the lower completion assembly 395 is positioned within an open-hole section of the wellbore, the coupler 435 is coupled to the coupler 440 such that the pump 175 and/or the accumulator 185 are hydraulically coupled to the inflow control devices 115 and 120 and the controller 190 is in communication with the sensors 105 and 110. Additionally, and in one or more exemplary embodiments, the method 250 may have an additional step of decoupling the coupler 435 and the coupler 440, and removing the coupler 440, the pump 175, the motor 180, the accumulator 185, the controller 190, and the power source 405 from the fluid flow passage 150*b*. Any one of the coupler 440, the pump 175, the motor 180, the accumulator 185, the controller 190, and the power source 405 may be repaired or replaced and then the coupler 440, the pump 175, the motor 180, the accumulator 185, the controller 190, and the power source 405 may be lowered downhole and recoupled to the coupler 435.

Figure 10B:
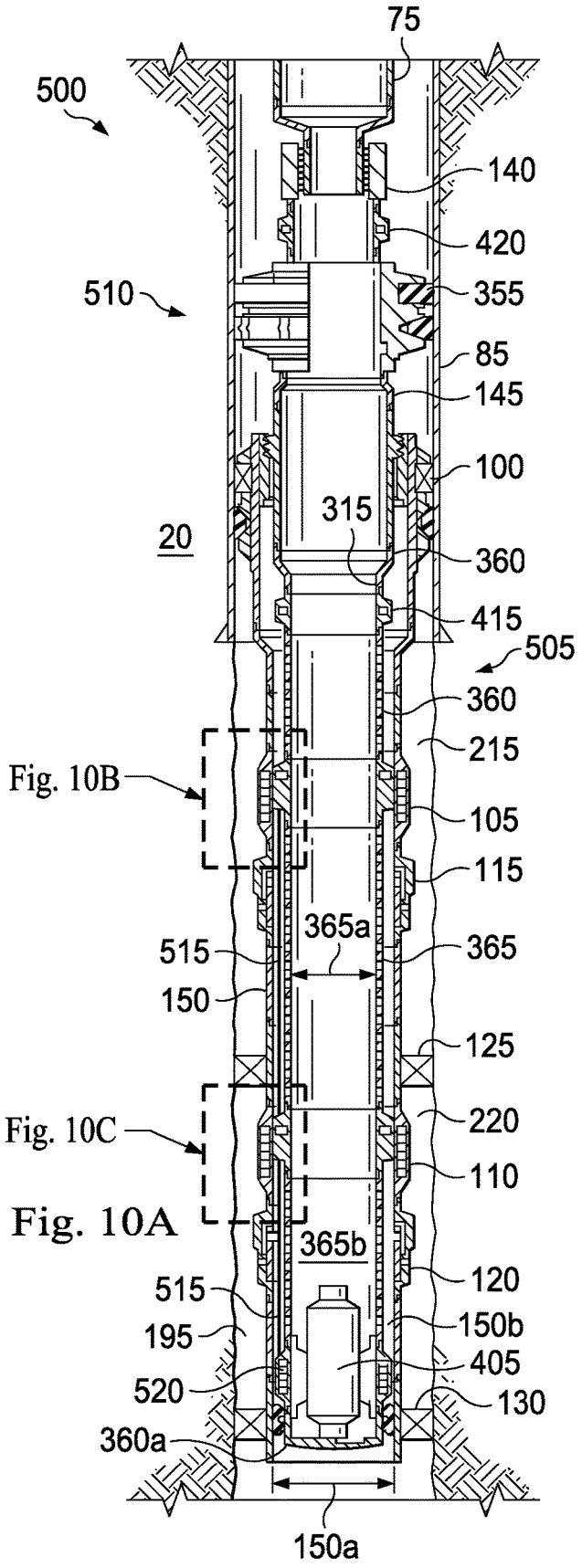
FIG. 10B illustrates an enlarged portion of the casing-based intelligent completion assembly of FIG. 10A, according to an exemplary embodiment of the present disclosure.
Figure 10B:
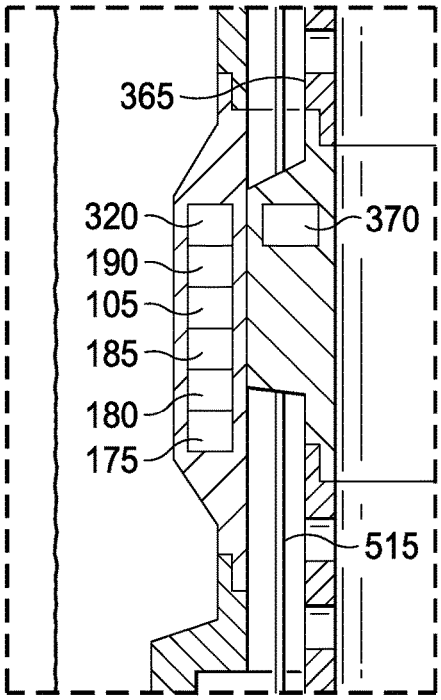
Figure 10C:
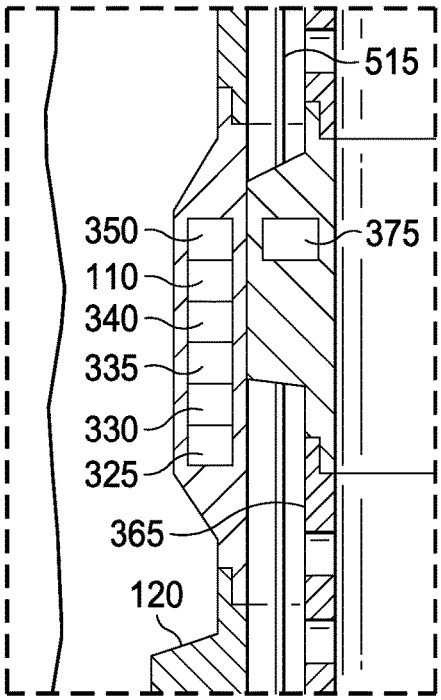
FIG. 10C illustrates another enlarged portion of the casing-based intelligent completion assembly of FIG. 10A, according to an exemplary embodiment of the present disclosure.

An alternative embodiment of the casing-based intelligent completion assembly 300 is a remotely-powered casing-based intelligent completion assembly 500. FIG. 10A illustrates a sectional view of the remotely-powered casing-based intelligent completion assembly 500. FIG. 10B illustrates an enlarged portion of the casing-based intelligent completion assembly 500. FIG. 10C illustrates another enlarged portion of the casing-based intelligent completion assembly 500. Generally, the casing-based intelligent completion assembly 500 is similar to the casing-based intelligent completion assembly 300. The casing-based intelligent completion assembly 500 includes a lower completion assembly 505 that couples to an upper completion assembly 510. As illustrated in FIGS. 10A, 10B, and/or 10C, the lower completion assembly 505 generally includes the liner 150 having the packers 125 and 130 axially spaced apart along the liner 150. The lower completion assembly 505 also includes the hanger 100, the inflow control devices 115 and 120, and the sensors 105 and 110.

However, the upper completion assembly 510 does not include the control line 205. Instead, the lower completion assembly 505 includes an electrical line 515, the retrievable stand-alone power source 405, the wireless transmitter 415, and the wireless repeater 420 that is located on the tubing string 75. In an exemplary embodiment, the wireless transmitter 415 is located on or forms a portion of the tubing 365 and is positioned near the hanger 100. In an exemplary embodiment, the electrical line 515 extends between the wireless transmitter 415, the first and second communication devices 370 and 375, and a communication device 520 that receives an electric signal from the stand-alone power source 405. In an exemplary embodiment, the communication device 520 electrically couples with the stand-alone power source 405 and is located on, or forms a portion of, the insert string 360 and/or the perforated tubing 365. The electrical line 515 does not extend to the surface of the well. The communication device 520 is coupled to the stand-alone power source 405 and receives and or transmits data and or a signal, such as for example, receive an electrical signal from the stand-alone power source 405. The stand-alone power source 405 powers the controller 190 via the communication device 520. The stand-alone power source 405 may be located within the fluid flow passage 365*b* and detachably couples to the tubing 365. The stand-alone power source 405 may be positioned within the fluid flow passage 365*b* at a location downhole from the communication devices 370 and 375.

The method of operating the assembly 500 is the substantially similar to the method 250 of operating the assembly 300. However, the method of operating the assembly 500 does not include powering any of the components within the lower completion assembly 505 using the electrical line 205 that extends to the surface of the well. Instead, the components within the assembly 500 are powered using the stand-alone power source 405 and does not include any electrical lines that extend to the surface of the well.

Assembly 500 forms a downhole casing-based wireless intelligent completion assembly, which is isolated from any power source located on the surface of the well. That is, no electrical lines extend from the surface of the well and to the downhole casing-based wireless intelligent completion assembly. The stand-alone power source 405 powers the assemblies 380 and 500. In an exemplary embodiment, communication between a component at the surface of the well, or a downhole tool, and the assembly 500 is transmitted via tubing conveyed repeaters and transmitters, such as for example the wireless repeater 420 and the wireless transmitter 415. Wireless telemetry such as radio modem, electromagnetic wave telemetry, or acoustic telemetry is utilized to wirelessly communicate with the assembly 500.

Exemplary embodiments of the present disclosure can be altered in a variety of ways. In some embodiments, any number of inflow control devices and corresponding sensors may be included such that any number of production zones may be managed using the assemblies 90, 300, 380, 430, and 500 and the method 250.

Figure 11:
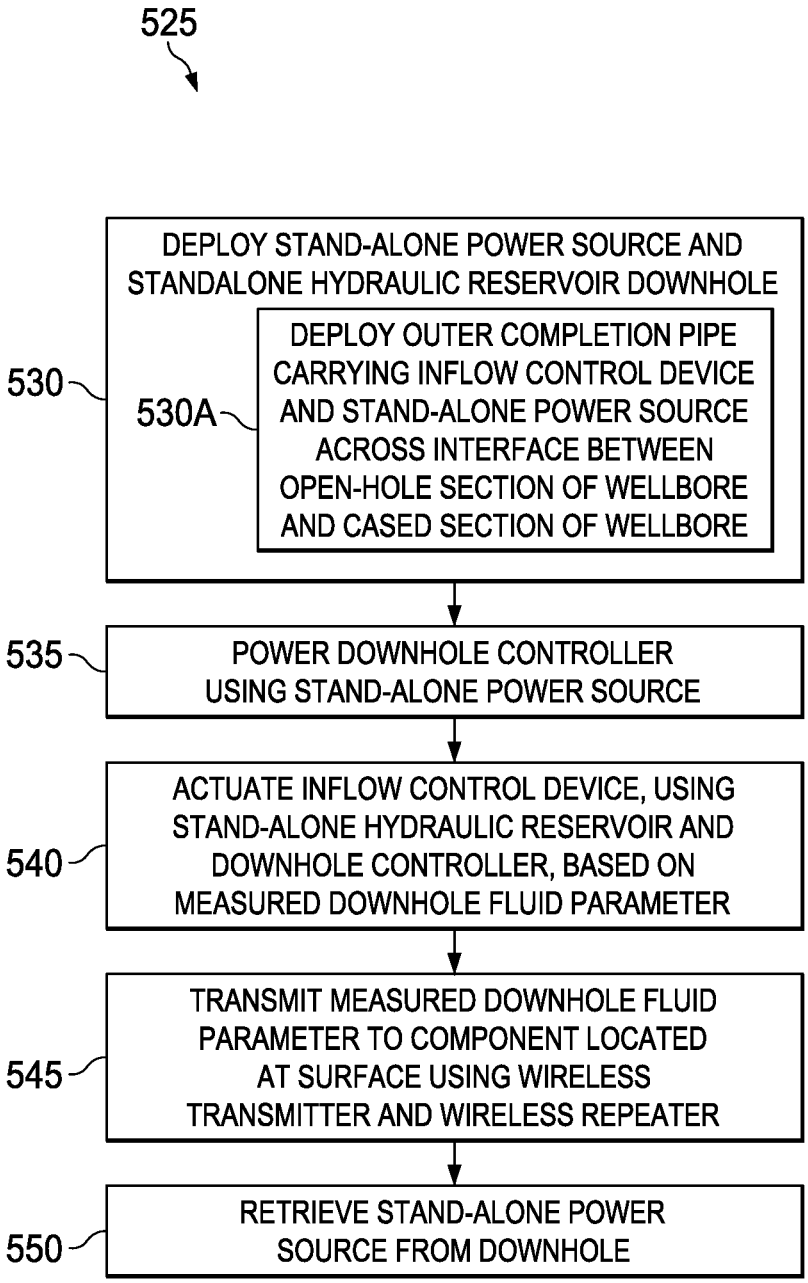
FIG. 11 is a flow chart illustration of a method of operating the assembly of FIG. 7A, according to an exemplary embodiment.

FIG. 11 is a flow chart illustration of a method 525 of operating each of the assemblies 380, 430, and 500, and includes: deploying the stand-alone power source 405 and the stand-alone hydraulic reservoir downhole at step 530; powering the downhole controller using the stand-alone power source 405 at step 535; actuating the inflow control device, using the stand-alone hydraulic reservoir and the downhole controller, based on the measured downhole fluid parameter at step 540; transmitting the measured downhole fluid parameter or other related data to a component located at the surface using the wireless transmitter 415 and the wireless repeater 420 at step 545; and retrieving the stand-alone power source 405 from downhole at step 550. The step 530 may include the sub-step of deploying an outer completion pipe (e.g., the liner 150) carrying the inflow control device and the stand-alone power source 405 across an interface between the open-hole section of the wellbore and the cased section of the wellbore.

Figure 12:
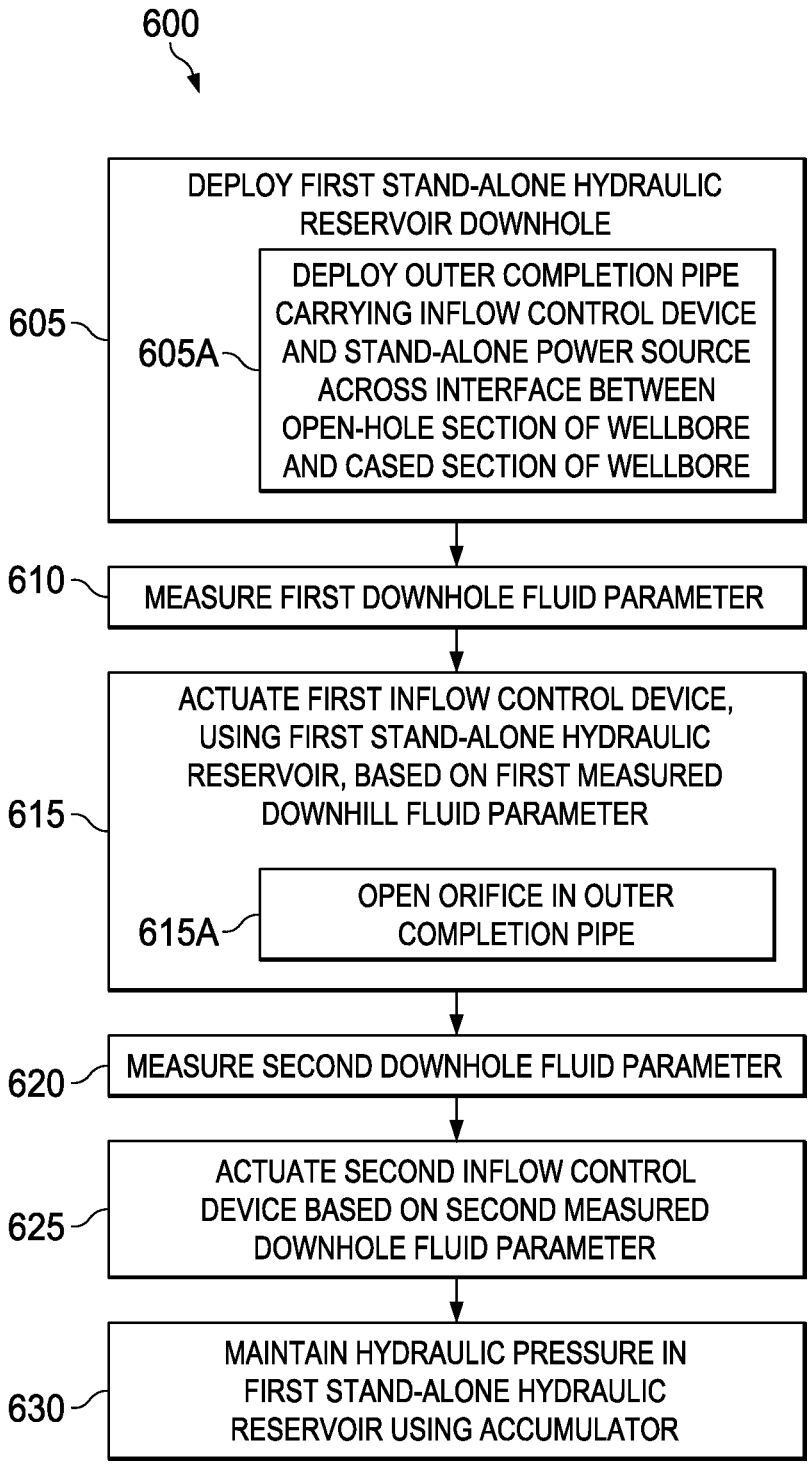
FIG. 12 is a flow chart illustration of a method of operating the assembly of FIG. 2A, according to an exemplary embodiment.

FIG. 12 is a flow chart illustration of a method 600 of operating each of the assemblies 90, 300, 380, 430, and 500, and includes: deploying a first stand-alone hydraulic reservoir downhole at step 605; measuring a first downhole fluid parameter at step 610; actuating the first inflow control device, using the first stand-alone hydraulic reservoir, based on the first measured downhole fluid parameter at step 615; measuring a second downhole fluid parameter at step 620; actuating a second inflow control device based on the second measured downhole fluid parameter at step 625; and maintaining hydraulic pressure in the first stand-alone hydraulic reservoir using the accumulator at step 630. The step 605 may include a sub-step 605*a* of deploying an outer completion pipe (e.g., the liner 150) carrying the inflow control device and the stand-alone power source across an interface between the open-hole section of the wellbore and the cased section of the wellbore. Additionally, the step 615 may include the sub-step 615*a* of opening an orifice in the outer completion pipe. Moreover, actuating the second inflow control device based on the second measured downhole fluid parameter at the step 625 may include using the first stand-alone hydraulic reservoir or using a second stand-alone hydraulic reservoir.

The casing-based intelligent completion assembly 90 may be or may form a portion of an open-hole completion system.

Forces or movement in the axial direction are generally perpendicular to forces or movement in the radial direction. The axial direction is generally perpendicular to the radial direction.

In several exemplary embodiments, a plurality of instructions stored on a non-transitory computer readable medium, which may form a part of the controller 190 or 340, may be executed by one or more processors, which may form a part of the controller 190 or 340, to cause the one or more processors to carry out or implement in whole or in part the above-described operation of each of the above-described exemplary embodiments of the system, the method, and/or any combination thereof.

In several exemplary embodiments, while different steps, processes, and procedures are described as appearing as distinct acts, one or more of the steps, one or more of the processes, and/or one or more of the procedures may also be performed in different orders, simultaneously and/or sequentially. In several exemplary embodiments, the steps, processes and/or procedures may be merged into one or more steps, processes and/or procedures. In several exemplary embodiments, one or more of the operational steps in each embodiment may be omitted. Moreover, in some instances, some features of the present disclosure may be employed without a corresponding use of the other features. Moreover, one or more of the above-described embodiments and/or variations may be combined in whole or in part with any one or more of the other above-described embodiments and/or variations.

Thus, a downhole control method for use in a wellbore has been described. Embodiments of the downhole control method for use in a wellbore method may generally include: deploying a first stand-alone hydraulic reservoir downhole; measuring a first downhole fluid parameter; and actuating a first inflow control device, based on the first measured downhole fluid parameter, using the first stand-alone hydraulic reservoir. For any of the foregoing embodiments, the method may include any one of the following elements, alone or in combination with each other:

- Positioning the first inflow control device in an open-hole section of the wellbore utilizing an outer completion pipe.
- Actuating the first inflow control device using the first stand-alone hydraulic reservoir includes opening an orifice in the outer completion pipe.
- Deploying the first stand-alone hydraulic reservoir downhole includes deploying an outer completion pipe carrying the first inflow control device across an interface between an open-hole section of the wellbore and a cased section of the wellbore.
- Deploying the outer completion pipe across the interface between the open-hole section of the wellbore and the cased section of the wellbore includes hanging the outer completion pipe from the cased section of the wellbore such that the outer completion pipe at least partially extends within the open-hole section of the wellbore.
- Measuring a second downhole fluid parameter and actuating a second inflow control device, based on the second measured downhole fluid parameter, using the first stand-alone hydraulic reservoir.
- Measuring a second downhole fluid parameter and actuating a second inflow control device, based on the second measured downhole fluid parameter, using a second stand-alone hydraulic reservoir.
- The first stand-alone hydraulic reservoir and the first inflow control device comprise an open-hole completion system.
- Maintaining hydraulic pressure in the first stand-alone hydraulic reservoir using an accumulator.
- Actuating the first inflow control device results in controlling flow of a fluid into a flow passage of the outer completion pipe.
- Operating a packer to isolate a first zone from a second zone of the open-hole section of the wellbore while maintaining hydraulic communication between the first zone and the second zone of the open-hole section of the wellbore.

Thus, downhole completion apparatus has been described. Embodiments of the apparatus may generally include a casing; a sensor carried by the casing to measure a fluid parameter at an external surface of the casing; and an inflow control device carried by the casing to control flow of a fluid into a flow passage of the casing; a stand-alone, downhole hydraulic reservoir hydraulically coupled to the inflow control device; and a downhole controller in communication with the sensor and the stand-alone, downhole hydraulic reservoir. For any of the foregoing embodiments, the apparatus may include any one of the following elements, alone or in combination with each other:

- A motor in communication with a pump and the downhole controller, wherein the pump is hydraulically coupled to the stand-alone, downhole hydraulic reservoir.
- The stand-alone, downhole hydraulic reservoir and the downhole controller form a portion of the casing.
- A tubing string that is coupled to the casing, wherein the stand-alone, downhole hydraulic reservoir and the downhole controller are located on the tubing string.

The outer completion assembly further includes a first communication device carried by the casing and in communication with the downhole controller.

The tubing string further includes an insert string coupled to the tubing string and sized to extend within the flow passage of the casing.

The insert string includes a second communication device that corresponds with the first communication device to send data or a signal to the first communication device.

The apparatus forms a portion of an open-hole completion system.

Thus, a downhole control method for use in a wellbore has been described. Embodiments of the downhole control method for use in a wellbore method may generally include: positioning a plurality of downhole devices along an outer completion pipe in an open-hole section of the wellbore; actuating a one of the plurality of downhole devices using a downhole, stand-alone hydraulic reservoir that is hydraulically coupled to the one of the plurality of downhole devices to control flow of fluids into a flow passage of the outer completion pipe. For any of the foregoing embodiments, the method may include any one of the following elements, alone or in combination with each other:

Actuating the one of the plurality of downhole device is in response to a measured downhole fluid condition.

Actuating another one of the plurality of downhole devices using the downhole, stand-alone hydraulic reservoir in response to another measured downhole fluid condition.

The foregoing description and figures are not drawn to scale, but rather are illustrated to describe various embodiments of the present disclosure in simplistic form. Although various embodiments and methods have been shown and described, the disclosure is not limited to such embodiments and methods and will be understood to include all modifications and variations as would be apparent to one skilled in the art. Therefore, it should be understood that the disclosure is not intended to be limited to the particular forms disclosed. Accordingly, the intention is to cover all modifications, equivalents and alternatives falling within the spirit and scope of the disclosure as defined by the appended claims.

What is claimed is:

1. A downhole control method for use in a wellbore, comprising:

positioning a lower completion assembly comprising an outer completion pipe within an open-hole section of the wellbore;

wherein the outer completion pipe has an inner surface that defines a flow passage, electrically coupling the lower completion assembly to an upper completion and hydraulically coupling the lower completion assembly to the upper completion using a hydraulic control line, measuring a first downhole fluid parameter using a downhole sensor;

receiving, by a downhole controller, the first measured downhole fluid parameter from the downhole sensor; and actuating a first inflow control device, based on the first measured downhole fluid parameter received from the downhole sensor by the downhole controller, using a first stand-alone hydraulic reservoir and the downhole controller; and maintaining hydraulic pressure in the first stand-alone hydraulic reservoir using an accumulator that is positioned within the flow passage of the outer completion pipe;

wherein the downhole controller is positioned within the flow passage of the outer completion pipe.

2. The method of claim 1, further comprising positioning the first inflow control device in an open-hole section of the wellbore utilizing the outer completion pipe.

3. The method of claim 2, wherein actuating the first inflow control device using the first stand-alone hydraulic reservoir comprises opening an orifice in the outer completion pipe.

4. The method of claim 1, wherein positioning the outer completion pipe within the wellbore comprises carrying the first inflow control device across an interface between the open-hole section of the wellbore and a cased section of the wellbore.

5. The method of claim 1, wherein positioning the outer completion pipe within the wellbore comprises hanging the outer completion pipe from a cased section of the wellbore such that the outer completion pipe at least partially extends within an open-hole section of the wellbore.

6. The method of claim 1, further comprising:

measuring a second downhole fluid parameter; and actuating a second inflow control device, based on the second measured downhole fluid parameter, using the first stand-alone hydraulic reservoir.

7. The method of claim 1, further comprising:

measuring a second downhole fluid parameter; and actuating a second inflow control device, based on the second measured downhole fluid parameter, using a second stand-alone hydraulic reservoir.

8. The method of claim 1, wherein the first stand-alone hydraulic reservoir and the first inflow control device comprise an open-hole completion system.

9. The method of claim 2, wherein actuating the first inflow control device results in controlling flow of a fluid into the flow passage of the outer completion pipe.

10. The method of claim 2, further comprising operating a packer to isolate a first zone from a second zone of the open-hole section of the wellbore while maintaining hydraulic communication between the first zone and the second zone of the open-hole section of the wellbore.

11. A downhole completion apparatus for use in an open-hole section of a wellbore, comprising:

an outer completion assembly, comprising:

a casing having an inner surface that defines a flow passage;

a sensor carried by the casing to measure a fluid parameter at an external surface of the casing; and an inflow control device carried by the casing to control flow of a fluid into a flow passage of the casing;

a stand-alone, downhole hydraulic reservoir hydraulically coupled to the inflow control device; and a downhole controller in communication with the sensor and the stand-alone, downhole hydraulic reservoir;

wherein the downhole controller is configured to actuate the inflow control device in response to data, received by the downhole controller from the sensor, regarding the measured fluid parameter; and wherein at least a portion of each of the downhole controller and the stand-alone, downhole hydraulic reservoir is positioned within the flow passage of the casing.

12. The apparatus of claim 11, further comprising:

a motor in communication with a pump and the downhole controller, wherein the pump is hydraulically coupled to the stand-alone, downhole hydraulic reservoir; and an accumulator that forms a portion of the stand-alone, downhole hydraulic reservoir;

wherein the motor, the accumulator, and the pump are positioned within the flow passage of the casing.

13. The apparatus of claim 11, wherein the apparatus forms a portion of an open-hole completion system.

14. A downhole control method for use in a wellbore, comprising:

positioning a plurality of downhole devices along an outer completion pipe in an open-hole section of the wellbore;

electrically coupling at least one of the plurality of downhole devices to an upper completion assembly and hydraulically coupling at least one of the plurality of downhole devices to the upper completion using a hydraulic control line;

measuring a downhole fluid condition using a downhole sensor;

transmitting data regarding the measured downhole fluid condition from the downhole sensor to a downhole controller;

actuating a one of the plurality of downhole devices using the downhole controller and a downhole, stand-alone hydraulic reservoir that is hydraulically coupled to the one of the plurality of downhole devices to control flow of fluids into a flow passage of the outer completion pipe defined by an inner surface of the outer completion pipe; and maintaining hydraulic pressure in the stand-alone hydraulic reservoir using an accumulator that is positioned within the flow passage of the outer completion pipe;

wherein the downhole controller is positioned within the flow passage of the outer completion pipe;

wherein actuating the one of the plurality of downhole device is in response to the downhole controller receiving the data regarding the measured downhole fluid condition from the downhole sensor.

15. The method of claim 14, further comprising actuating another one of the plurality of downhole devices using the downhole controller and the downhole, stand-alone hydraulic reservoir in response to another measured downhole fluid condition.

16. The method of claim 2, further comprising powering the downhole controller using a stand-alone power source that is positioned within the flow passage; wherein the power source is coupled to the downhole controller.

17. The apparatus of claim 11, further comprising a stand-alone power source positioned within the flow passage; wherein the power source is coupled to each of the downhole controller and the stand-alone, downhole hydraulic reservoir.

18. The method of claim 14, further comprising powering the downhole controller using a stand-alone power source that is positioned within the flow passage; wherein the power source is coupled to the downhole controller.

* * * * *